US005797730A

United States Patent [19]

Kawaguchi et al.

[11] Patent Number: 5,797,730

[45] Date of Patent: Aug. 25, 1998

[54] SWASH PLATE TYPE COMPRESSOR

[75] Inventors: Masahiro Kawaguchi; Masanori Sonobe; Tomohiko Yokono; Ken Suitou, all of Kariya, Japan

[73] Assignee: Kabushiki Kaisha Toyoda Jidoshokki Seisakusho, Kariya, Japan

[21] Appl. No.: 705,068

[22] Filed: Aug. 29, 1996

Related U.S. Application Data

[63] Continuation of Ser. No. 255,043, Jun. 7, 1994, abandoned.

[30] Foreign Application Priority Data

Jun. 8, 1993 [JP] Japan ..... 5-137931
Jun. 22, 1993 [JP] Japan ..... 5-150878

[51] Int. Cl.[6] ..... F04B 1/29

[52] U.S. Cl. ..... 417/222.2; 417/295

[58] Field of Search ..... 417/222.1, 222.2, 417/295, 269

[56] References Cited

U.S. PATENT DOCUMENTS

| | | | |
|---|---|---|---|
| 4,801,248 | 1/1989 | Toju et al. | 417/222.2 |
| 4,913,626 | 4/1990 | Terauchi | 417/222.2 |
| 5,017,096 | 5/1991 | Sugiura et al. | 417/222.2 |
| 5,105,728 | 4/1992 | Hayase et al. | 417/222.2 |
| 5,173,032 | 12/1992 | Taguchi et al. | 417/222.2 |
| 5,242,274 | 9/1993 | Inoue | 417/222.2 |
| 5,286,172 | 2/1994 | Taguchi | 417/222.2 |
| 5,332,365 | 7/1994 | Taguchi | 417/222.2 |
| 5,342,178 | 8/1994 | Kimura et al. | 417/222.2 |
| 5,529,461 | 6/1996 | Kawaguchi et al. | 417/222.2 |
| 5,577,894 | 11/1996 | Kawaguchi et al. | 417/222.2 |
| 5,584,670 | 12/1996 | Kawaguchi et al. | 417/222.2 |
| 5,586,870 | 12/1996 | Kawaguchi et al. | 417/222.2 |

FOREIGN PATENT DOCUMENTS

| | | | |
|---|---|---|---|
| 0297514 | 1/1989 | European Pat. Off. . | |
| 0300831 | 1/1989 | European Pat. Off. . | |
| 0536989 | 4/1993 | European Pat. Off. . | |
| 62-674 | 1/1987 | Japan | 417/222.2 |
| 282182 | 12/1987 | Japan | 417/222.2 |
| 243468 | 10/1988 | Japan | 417/222.2 |
| 64-56972 | 3/1989 | Japan | 417/222.2 |
| 2115576 | 4/1990 | Japan | 417/222.2 |
| 337378 | 2/1991 | Japan . | |
| 4179874 | 6/1992 | Japan . | |

*Primary Examiner*—Timothy Thorpe
*Assistant Examiner*—Peter G. Korytnyk
*Attorney, Agent, or Firm*—Brooks Haidt Haffner & Delahunty

[57] ABSTRACT

A compressor has a refrigerant gas passage selectively connected to and disconnected from a refrigerant circuit apart from the compressor. A swash plate is supported on a drive shaft for integral rotation with inclining motion with respect to the drive shaft to drive the pistons. The swash plate is moveable between a maximum inclined angle and a minimum inclining angle. A disconnecting member disconnects the refrigerant circuit from the refrigerant gas passage when the swash plate is at the minimum inclined angle.

48 Claims, 13 Drawing Sheets

SWASH PLATE TYPE COMPRESSOR

This application is a continuation of application Ser. No. 08/255,043, filed Jun. 7, 1994 now abandoned.

BACKGROUND OF THE INVENTION

1. Field of the Invention

The present invention relates to a swash plate type compressor that uses no electromagnetic clutch.

2. Description of the Related Art

A clutchless type compressor, as disclosed in Japanese Unexamined Patent Publication No. 3-37378, does not use any electromagnetic clutch for either the transmission or cutting of power from an external driving source to the drive shaft of the compressor. The external driving source is coupled directly to the drive shaft.

Not using a clutch with direct connection between the driving source and drive shaft effectively eliminate-shocks caused by the ON/OFF action of the clutch. This tends to improve the comfort level of the driver during the vehicle's operation. The clutchless structure also contributes to a reduction in the overall weight and the cost of the cooling system.

In such a clutchless systems the compressor runs even when no cooling is needed. With such type of compressors, it is important that when cooling is unnecessary, the discharge displacement be reduced as much as possible in order to prevent the evaporator from undergoing frosting. Likewise, under these conditions, it is also important to stop the circulation of the refrigerant gas through the compressor, and its external refrigerant circuit.

The compressor described in Japanese Unexamined Patent Publication No. 3-37378, for example, is designed to block the flow of gas into the compressor's suction chamber from the external refrigerant circuit by the use of an electromagnetic valve. This valve selectively allows for the circulation of the gas through the external refrigerant circuit and the compressor. When gas circulation is blocked the pressure in the suction chamber drops and the control valve responsive to that pressure opens fully. The full opening of the control valve allows the gas in the discharge chamber to flow into the crank chamber, which in turn raises the pressure inside the crank chamber. The gas in the crank chamber is then supplied to the suction chamber. Accordingly, a short circulation path in formed which passes through the cylinder bores, the discharge chamber, the crank chamber, the suction chamber and back to the cylinder bores.

As the pressure in the suction chamber decreases, the suction pressure in the cylinder bores falls, causing an increase in the difference between the pressure in the crank chamber and the suction pressure in the cylinder bores. This pressure differential in turn minimizes the inclination of the swash plate which reciprocates the pistons. As a result, the compressor's discharge displacement, driving torque and power loan are minimized during times when cooling is unnecessary.

The aforementioned electromagnetic valve performs a simple ON/OFF action to instantaneously stop the gas flow from the external refrigerant circuit into the suction chamber. Naturally, when the valve is off, the amount of gas supplied into the cylinder bores from the suction chamber decreases drastically. This rapid decrease in the amount of gas flowing into the cylinder bores likewise causes a rapid decrease in the discharge displacement and discharge pressure. Consequently, the driving torque needed by the compressor is drastically reduced over a short period of time.

When the electromagnetic valve switches to an on position the amount of gas supplied to the cylinder bores from the suction chamber quickly increases as does the discharge displacement and discharge pressure. Consequently, the driving torque needed by the compressor undergoes a rapid rise over a short period of time.

This variation in torque, however, obstructs the suppression of shocks caused by the ON/OFF action that is the primary purpose of the clutchless system.

In the compressor disclosed in Japanese Unexamined Patent Publication No. 3-37378, the control valve controls the displacement of the compressor in response to the suction pressure. In this respect, the control valve is located downstream of the electromagnetic valve with the suction chamber disposed therebetween.

When the electromagnetic valve is closed to block the gas flow into the suction chamber, the gas pressure in the suction chamber remains low. Such a low gas pressure is an unreliable indicator of the cooling load.

Consequently, with compressors having the above construction, should the need for cooling arise or should the suction pressure undergo a rise in response to the cooling load, the control valve can not adequately respond. To overcome this shortcoming, a pressure sensor for detecting the suction pressure is used between the evaporator and the electromagnetic valve in the conventional compressor. In response to the cooling load, the pressure sensor provides a signal to the valve assembly, causing the electromagnetic valve to open.

The conventional compressor however requires the above described pressure sensor an well as its interconnections in order for the compressor to operate properly. This requirement effectively increases the conventional compressor's complexity as well as its price.

SUMMARY OF THE INVENTION

Accordingly, it is a primary objective of the present invention to suppress shocks caused by variation in driving torque needed by a compressor.

It is another objective of this invention to ensure adequate lubrication in a compressor.

It is a further objective of this invention to provide a compressor having a simple structure.

It is a still further objective of this invention to provide a compressor whose discharge displacement can be accurately regulated.

A compressor has a coolant gas passage selectively connected and disconnected with a coolant circuit apart from the compressor. A swash plate is supported on a drive shaft for integral rotation with inclining motion with respect to the drive shaft to drive the pistons. The swash plate is moveable between a maximum inclined angle and a minimum inclined angle. A disconnecting member disconnects the coolant circuit from the coolant gas passage when the swash plate is at the minimum inclined angle.

BRIEF DESCRIPTION OF THE DRAWINGS

The features of the present invention that are believed to be novel are set forth with particularity in the appended claims.

The invention, together with objects and advantages thereof, may beat be understood by reference to the following description of the presently preferred embodiments together with the accompanying drawings in which:

FIGS. 1 through 8 illustrate a first embodiment of the present invention.

FIG. 1 is a side cross-sectional view of an overall compressor according to the first embodiment;

FIG. 2 is a cross section taken along the line 2—2 in FIG. 1;

FIG. 3 is a partial cross-sectional view showing the interior of a rear housing;

FIG. 4 is a side cross-sectional view of the whole compressor with its swash plate at the minimum inclined angle;

FIG. 5 is an enlarged fragmentary cross-sectional view showing the essential portions with a spool located at an open position;

FIG. 6 is an enlarged fragmentary cross-sectional view showing the essential portions with the spool located at a closed position FIG. 7 is an enlarged fragmentary cross-sectional view of the essential portions, showing the spool located at the closed position with a deactivated solenoid;

FIG. 9 is a side cross-sectional view of an overall compressor according to the second embodiment;

FIG. 10 is a cross section taken along the line 10—10 in FIG. 9;

FIG. 11 is an enlarged fragmentary cross-sectional view showing the essential portions with a spool at an open position; and FIG. 12 is an enlarged fragmentary cross-sectional view showing the essential portions with the spool at a closed position.

DETAILED DESCRIPTION OF THE PREFERRED EMBODIMENTS

A swash plate type variable displacement compressor according to a first embodiment of the present invention will now be described referring to FIGS. 1 through 8.

Figure 1:
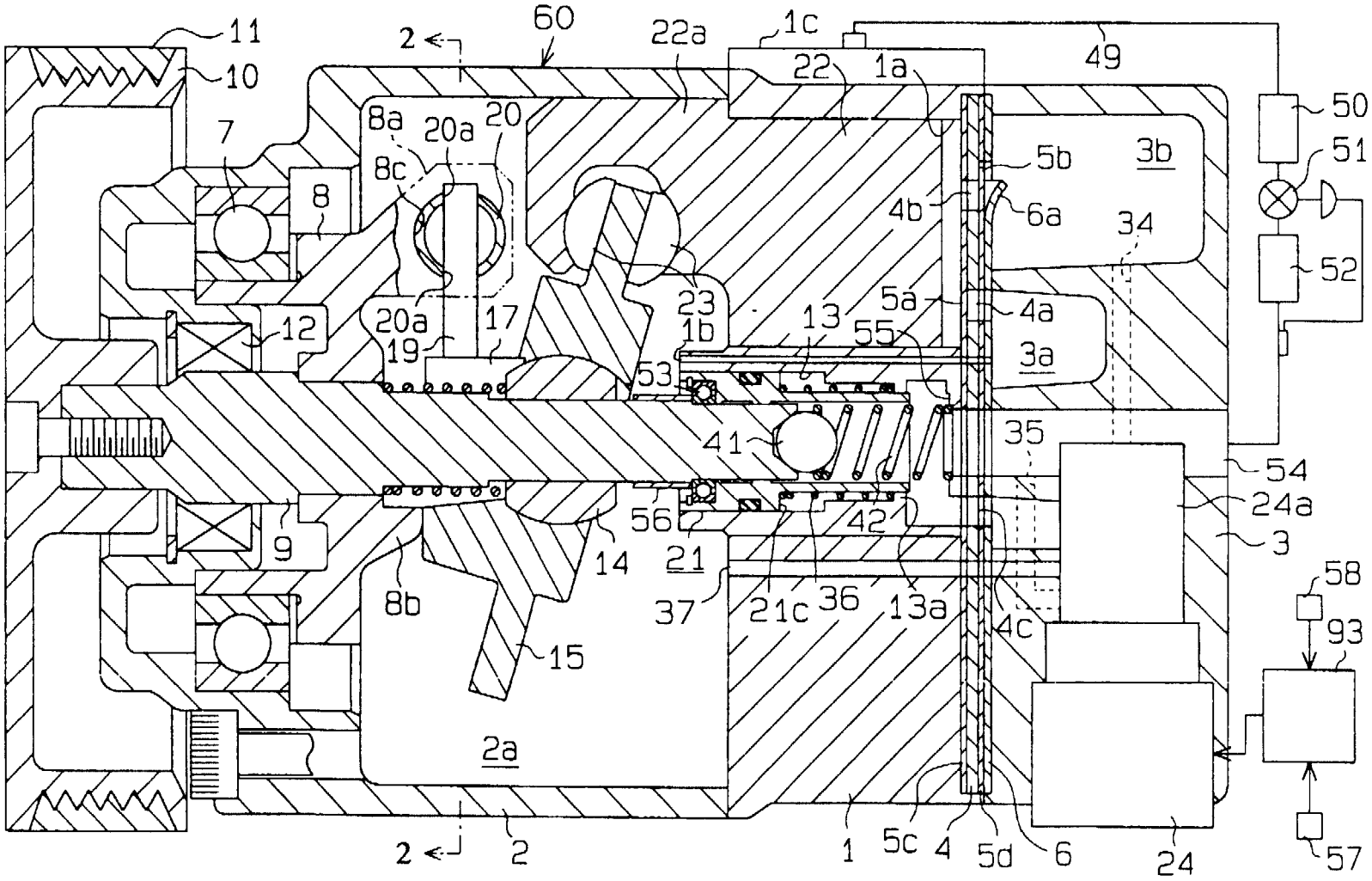
Figure 4:
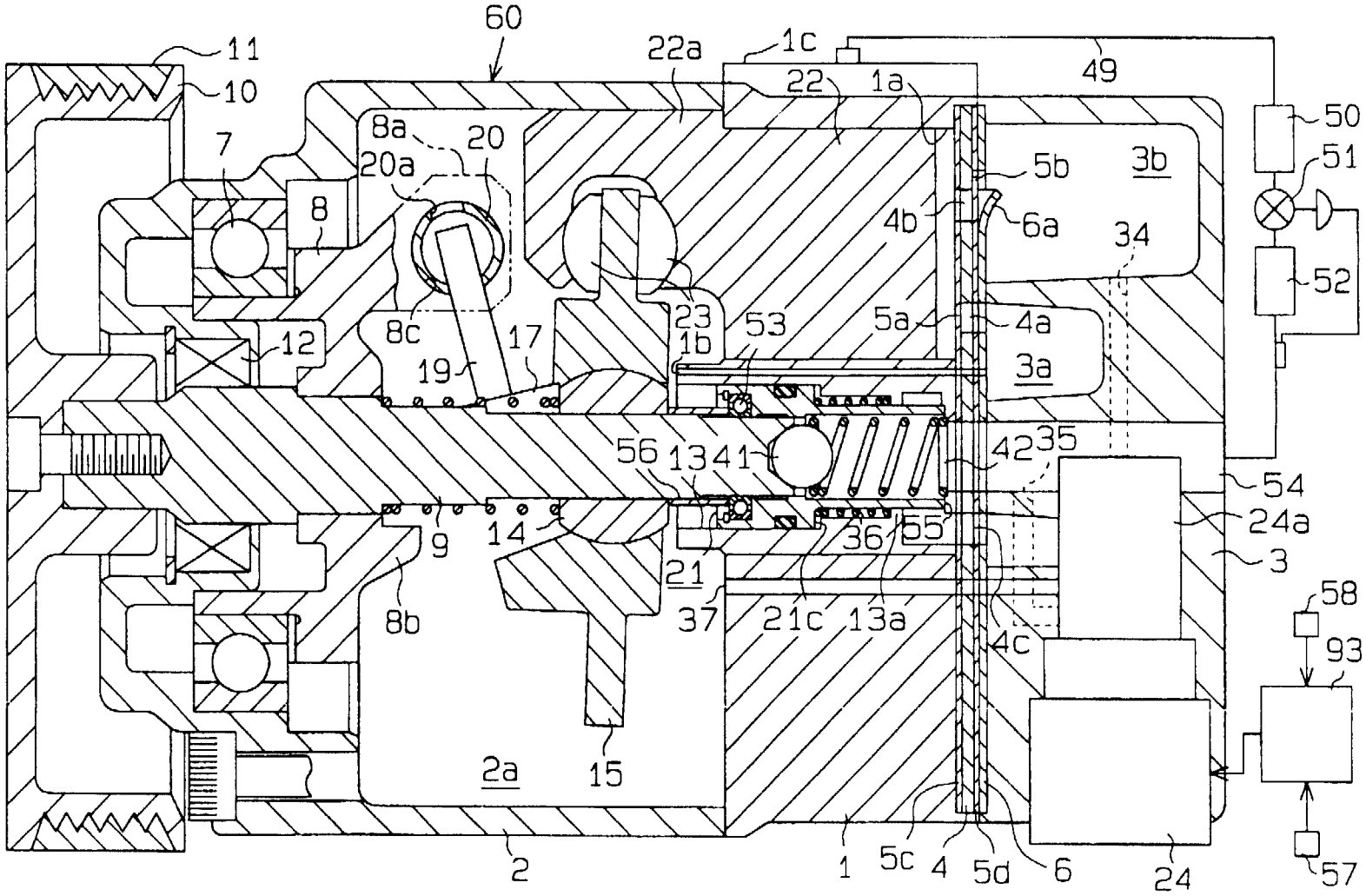

As shown in FIGS. 1 and 4, a front housing 2 and a rear housing 3 are secured to a cylinder block 1. The cylinder block 1, front housing 2 and roar housing 3 constitute a housing 60 of the compressor. Secured between the cylinder block 1 and the roar housing 3 are a first plate 4, a second plate 5*c*, a third plate 5*d* and a fourth plate 6. A crank chamber 2*a* in defined in the front housing 2 between the cylinder block 1 and the front housing 2.

A ball bearing 7 is attached inside the front housing 2. A drive plate 8 is supported by the inner race of the ball bearing 7, and a drive shaft 9 is secured to the drive plate 8. By means of the drive plate 8, the ball bearing 7 receives the thrust load and radial load which act on the drive shaft 9.

The drive shaft 9 protrudes outside the front housing 2, with a pulley 10 fixed to the protruding portion. The pulley 10 is coupled to a vehicle's engine (not shown) via a belt 11. No electromagnetic clutch intervenes between the pulley 10 and the engine. A lip seal 12 is located between the drive shaft 9 and the front housing 2 to prevent a pressure leak from the crank chamber 2*a*.

A support 14 having a convex surface is supported on the drive shaft 9 in such a way as to be slidable along the axial direction of the drive shaft 9. The support 14 supplies support to swash plate 15 and allows it to tilt at the center of support 14 where the surface of swash plate 15 is concave.

Figure 2:
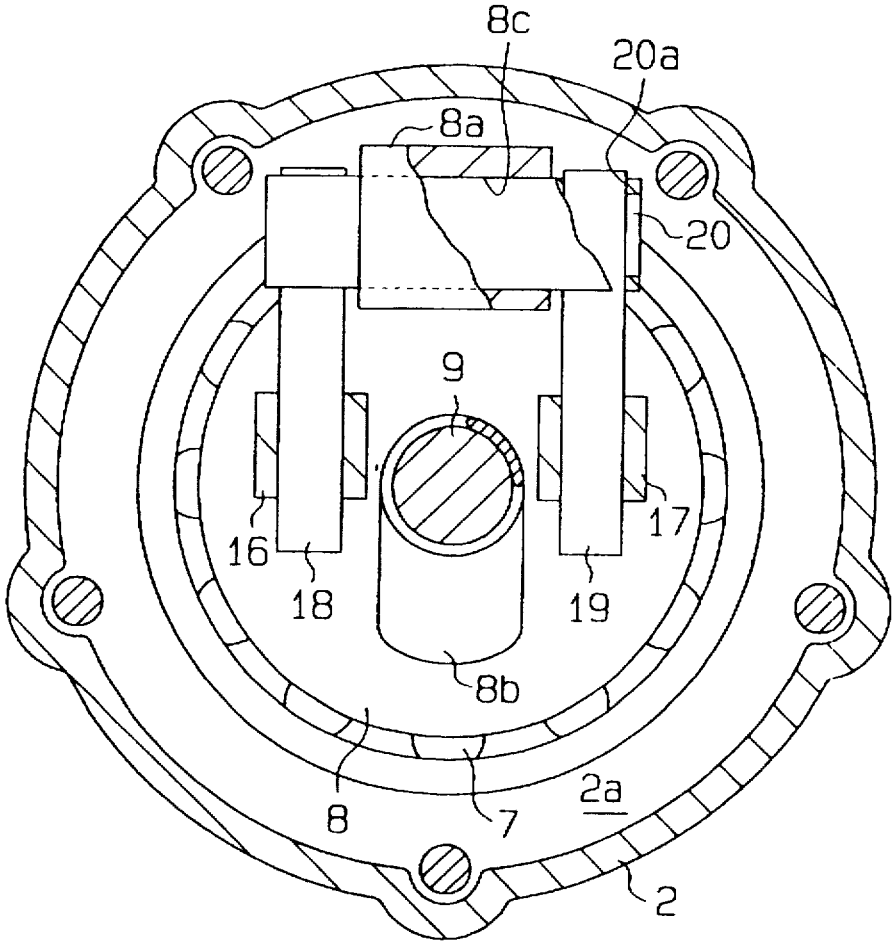

As shown in FIGS. 1 and 2, a pair of stays 16 and 17 are securely attached to the swash plate 15, with pins 18 and 19 respectively secured to the stays 16 and 17.

The drive plate 8 has a protruding arm 8*a* in which a hole 8*c* is formed extending in the direction perpendicular to the axis of the drive shaft 9. A pipe-shaped connector 20, rotatable about its axis, is inserted in the hole 8*c*. A pair of holes 20*a* are formed in the cylindrical wall of the connector 20, and the pine 18 and 19 are slidably fitted in the respective holes 20*a*.

The swash plate 15 rotates together with the drive plate 8 by the coupling of the pine 19 and 19 to the connector 20, i.e., the swash plate 15 rotates with the drive shaft 9. When the swash plate 15 tilts, the connector 20 rotates about its axis and the pins 18 and 19 move in the holes 20*a* along their axes.

Figure 5:
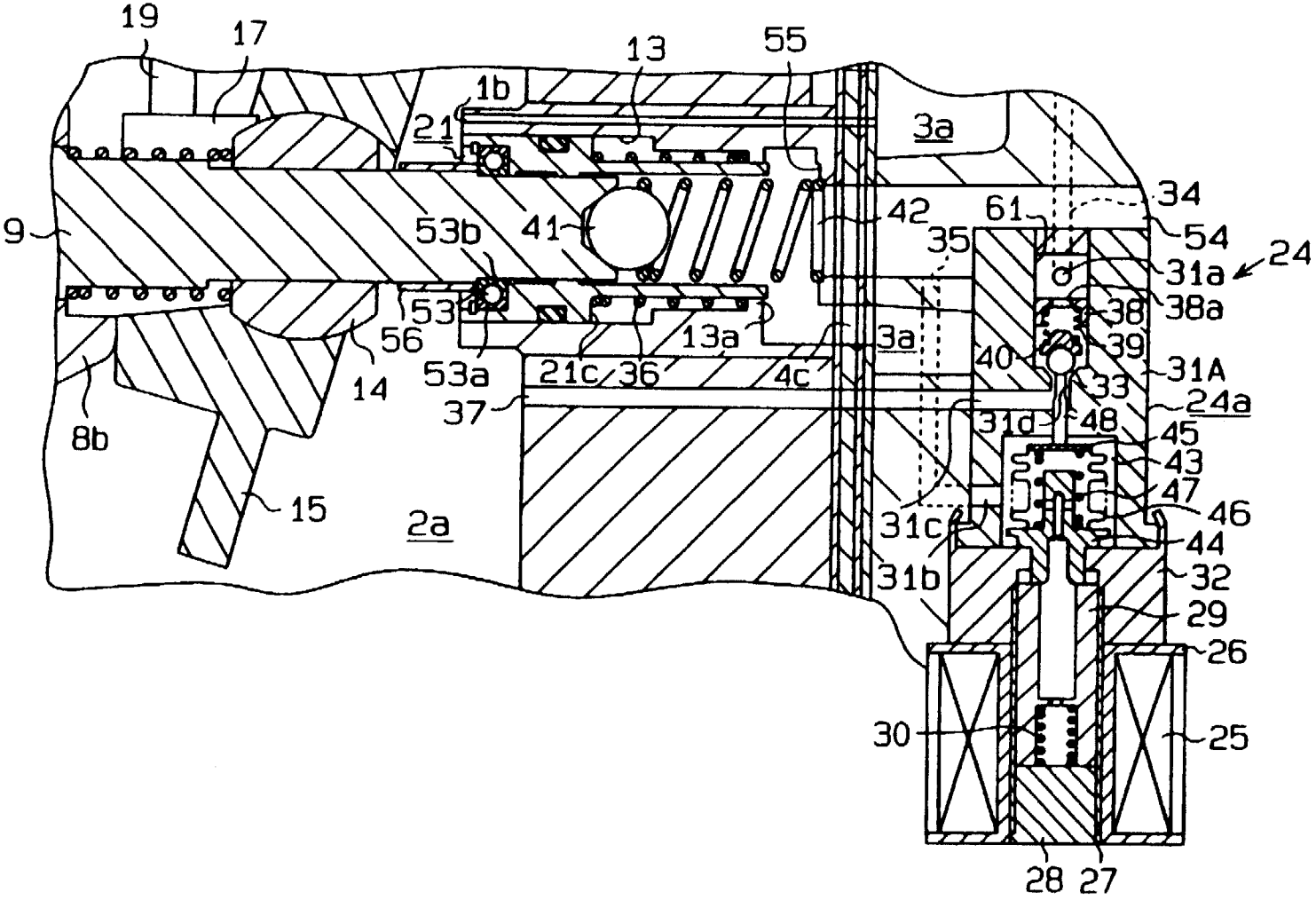

As shown in FIGS. 1, 4 and 5, a retainer hole 13 is formed in the center of the cylinder block 1 and extends along the axis of the drive shaft 9. A cylindrical spool 21 in retained slidable in the retainer hole 13. A flange 13*a* is formed on the inner wall of the retainer hole 13. A step 21*c* is formed at the outer wall of the spool 21. A spring 36 is disposed between the step 21*c* and the flange 13*a* to press the spool 21 toward the support 14.

The drive shaft 9 is fitted inside the spool 21. The drive shaft 9 is pressed via a ball 41 by a spring 42 which suppresses the movement of the drive shaft 9 in the thrust direction. A ball bearing 53 is located between the drive shaft 9 and the spool 21. The drive shaft 9 is supported on the inner wall of the retainer hole 13 via the ball bearing 53 and spool 21. The ball bearing 53 has an outer race 53*a* secured to the inner wall of the spool 21, and has an inner race 53*b* which is slidable on the outer surface of the drive shaft 9.

Figure 6:
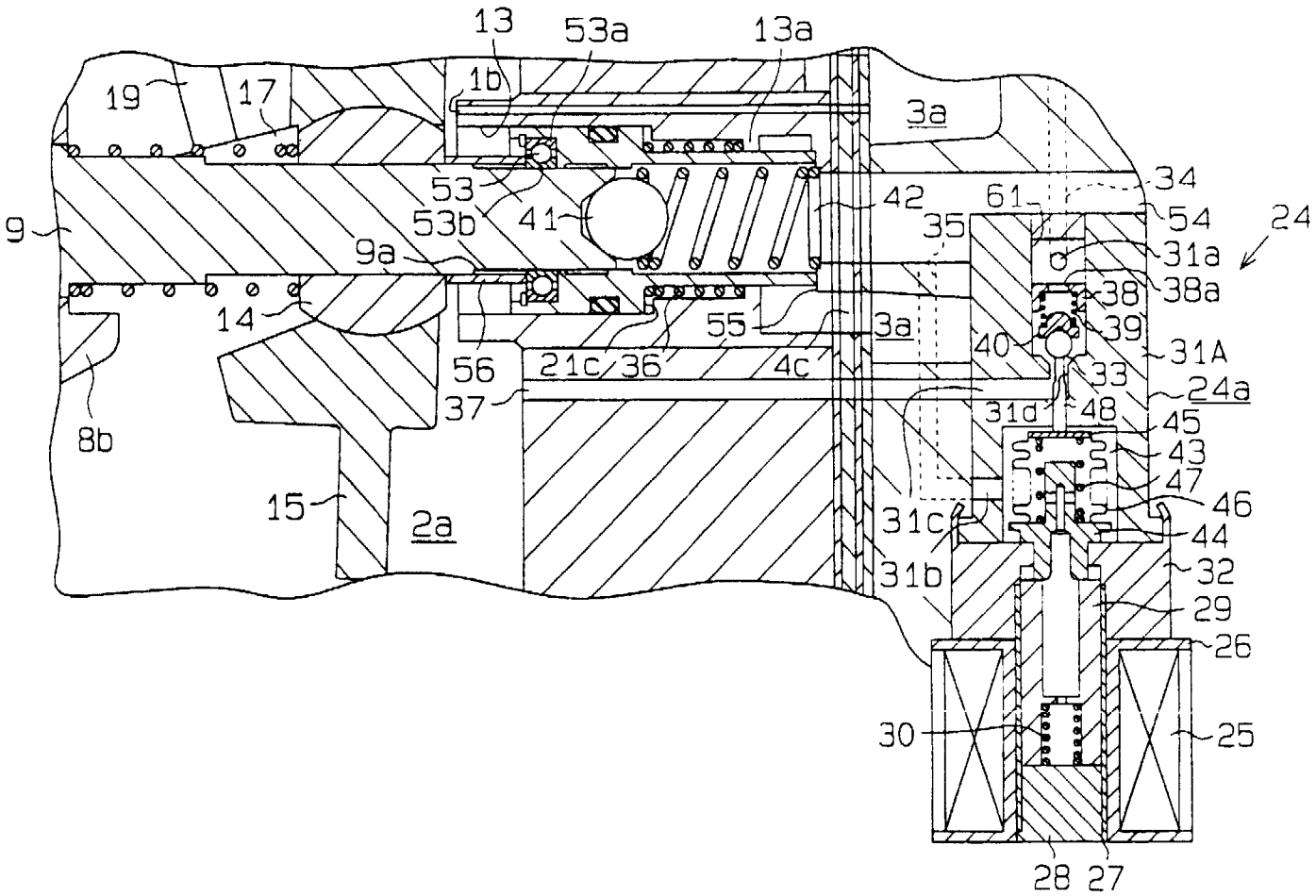
Figure 7:
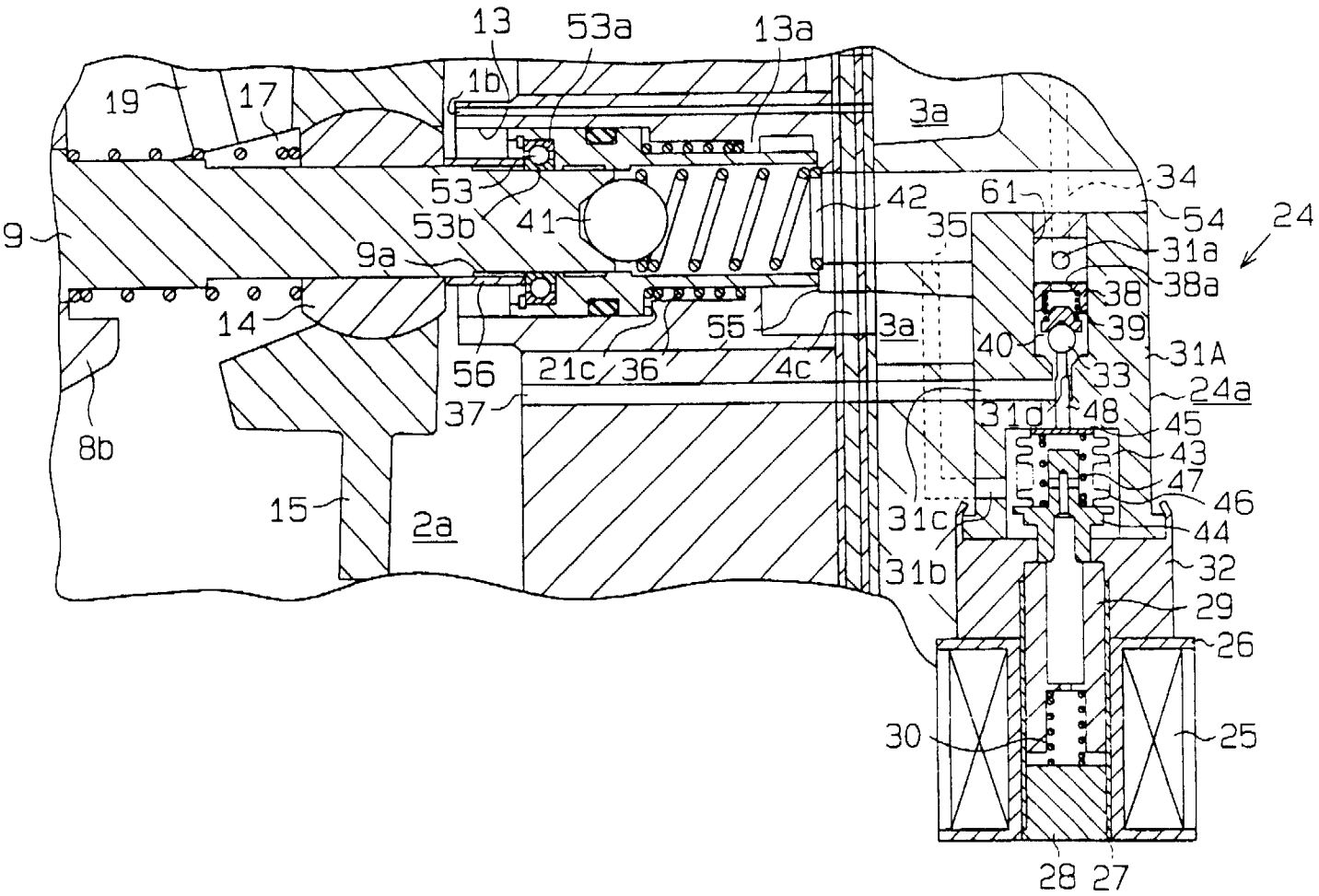

As shown in FIGS. 5 to 7, a restricting surface 55 is formed at the bottom of the retainer hole 13 of the spool 21. A step 9*a* (see FIGS. 6 and 7) is formed at the outer surf ace of the drive shaft 9. The spool 21 is movable between the position where it abuts the restricting surface 55 and the position where the inner race 53*b* of the ball bearing 53 abuts on the step 9*a*.

Figure 3:
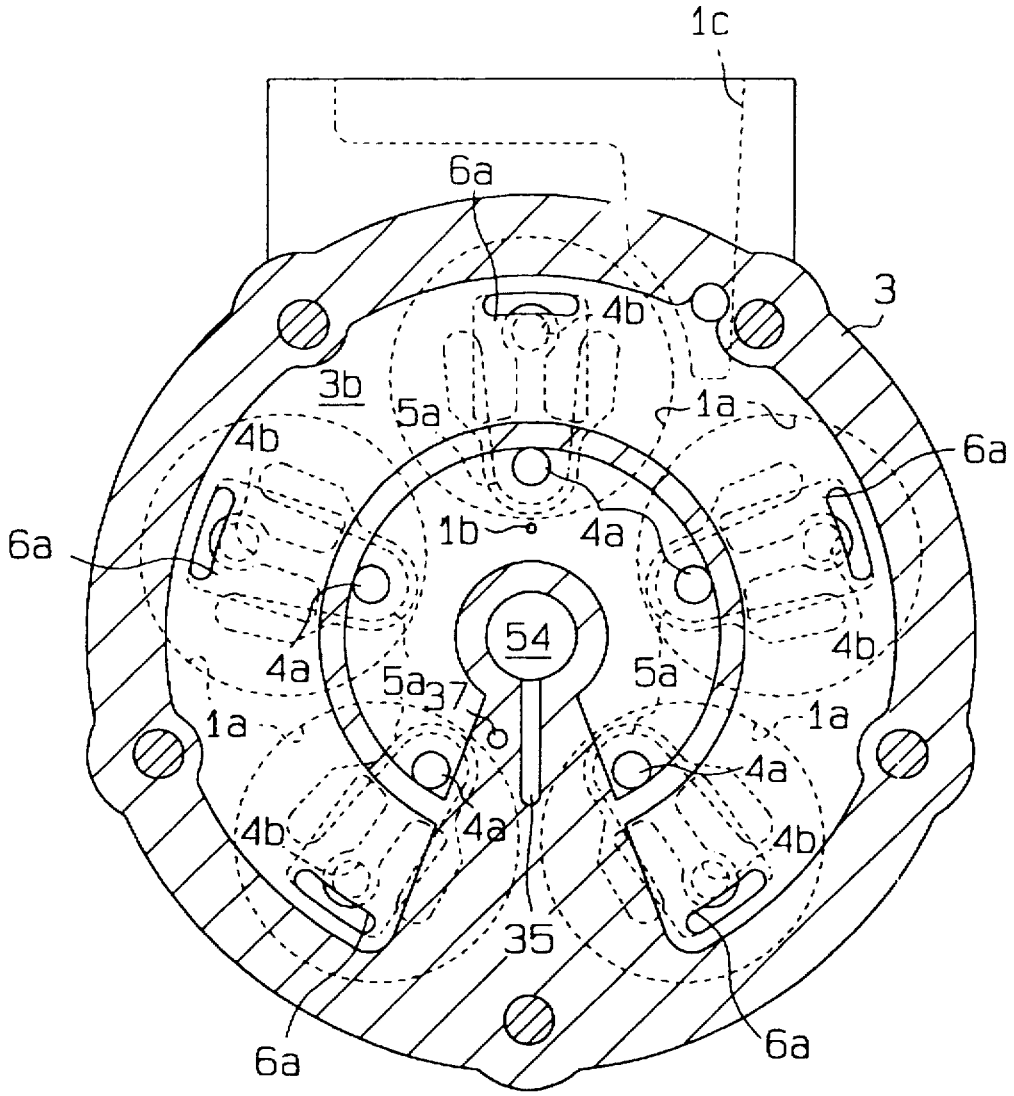

As shown in FIGS. 1, 3 and 4, a suction chamber 3*a* and a discharge chamber 3*b* are defined in the rear housing 3. A suction passage 54 is formed in the center of the rear housing 3 and communicates with the bottom of the retainer hole 13. Because the spool 21 abuts on the restricting surface 55, communication between the suction passage 54 and the retainer hole 13 is obstructed. The suction chamber 3*a* is connected via a passage 4*c* to the retainer hole 13.

When the spool 21 abuts the restricting surface 55, communication between the passage 4*c* and the suction passage 54 is obstructed. The suction passage 54, as illustrated is an inlet through which gas is supplied into the compressor. Additionally, when the spool 21 abuts surface 55, communication between the suction passage 54 and the retainer hole 13 is blocked. In case of either obstruction, the spool 21 is located at the downstream portion of the passage 54.

A pipe 56 is slidably provided on the drive shaft 9 between the support 14 and the ball bearing 53. An the support 14 moves toward the spool 21, the inner race 53*b* of the ball bearing 53 is pushed via the pipe 56 as shown in FIGS. 6 and 7. Consequently, the spool 21 moves toward the restricting surface 55 against the force of the spring 36.

The minimum inclined angle of the swash plate 15 is determined by the abutment of the spool 21 on the restricting surface 55. The minimum inclined angle of the swash plate 15 in slightly larger than 0 degree with respect to a plane perpendicular to the drive shaft 9. The maximum inclined angle of the swash plate 15 is determined by the abutment of a projection 8*b* of the drive plate 8 on the swash plate 15.

Pistons 22 are respectively placed in a plurality of cylinder bores 1*a* formed in the cylinder block 1. A pair of shoes 23 are fitted in a neck 22*a* of each piston 22. The swash plate 15 is placed between both shoes 23. The undulating movement of the swash plate 15, caused by the rotation of the drive shaft 9 is transmitted via the shoes 23 to each pistons 22. This causes linear reciprocation of the pistons 22.

As shown in FIGS. 1 and 3, an inlet port 4*a* and a discharge port 4*b* are formed in the first plate 4. An inlet valve 5*a* is provided on the second plate 5*c*, and a discharge valve 5*b* is provided on the third plate 5*d*.

The gas in the suction chamber 3*a* pushes the inlet valve 5*a* and enters the cylinder bore 1*a* through the inlet port 4*a* in accordance with the backward movement of the piston 22. The gas that has entered the cylinder bore 1*a* is compressed by the forward movement of the piston 22, and in then discharged to the discharge chamber 3*b* via the discharge port 4*b* while pushing the discharge valve 5*b*. Any excessive opening motion of the discharge valve 5*b* is inhibited by a retainer 6*a* on the fourth plate 6.

The suction passage 54 and a discharge port 1*c*, from which the gas from the discharge chamber 3*b* is discharged, are connected by an external refrigerant circuit 49. Provided in the circuit 49 are a condenser 50, an expansion valve 51 and an evaporator 52. The expansion valve 51 controls the amount of flowing gas in accordance with a change in gas pressure on the outlet side of the condenser 50. The pressure in the passage from the evaporator 52 to the cylinder bores 1*a* is a low value close to the suction pressure.

The inclined angle of the swash plate 15 varies in accordance with the changing pressure differential between the pressure in the crank chamber 2*a* and the suction pressure in each cylinder bore 1*a*. As the inclined angle of the swash plate 15 varies, the stroke of the piston 22 changes, thus changing the displacement of the compressor. The pressure in the crank chamber 2*a* is controlled by a displacement control valve 24 attached to the rear housing 3. The crank chamber 2*a* is connected to the suction chamber 3*a* via a passage 1*b* that has the function of a restriction.

The structure of the displacement control valve 24 will be described below with reference to FIGS. 5 through 7. A guide cylinder 27 is fixed to the hollow portion of a bobbin 26 that supports a solenoid 25. A fixed iron core 28 it fixed inside the guide cylinder 27. A movable iron core 29 in placed in the guide cylinder 27. A spring 30 is placed between the fixed core 28 and the movable core 29. The movable core 29 is urged away from the fixed core 28 by the force of the spring 30.

A valve housing 31A is secured via a block 32 to the bobbin 26. First and second chambers 61 and 43 are defined in the valve housing 31A, and are connected together by a passage 31*d*. A spherical valve assembly 33 is placed in the first chamber 61 that has a seat 38 secured thereto. A hole 38*a*, through which gas passes, is formed in the seat 38. A spring 39 and a seat 40 are provided between the seat 38 and the valve assembly 33. The valve assembly 33 receives the force of the spring 39 that acts in the direction to close the passage 31*d*.

A metal bellows 44, having an air tight interior, is disposed in the second chamber 43, and is fixed to the movable core 29. A plate 45 is fixed to the bellows 44 which in urged to expand by spring 47. A rod 48 is provided between the plate 45 and the valve assembly 33.

A first port 31*a* is formed in the first chamber 61, and a second port 31*b* is formed in the second chamber 43. A third port 31*c* is formed in the passage 31*d*. The first port 31*a* is connected via a passage 34 to the discharge chamber 3*b*. The second port 31*b* 1*a* connected via a passage 35 to the suction passage 54 at the upstream of the spool 21. The third port 31*c* is connected via a passage 37 to the crank chamber 2*a*.

The solenoid 25 is controlled by a computer 93. The computer 93 activates the solenoid 25 when an air conditioning switch 57 for activating an air conditioner is turned on or when an accelerator switch 58 is turned off. The computer deactivates the solenoid 25 when the air conditioning switch 57 in turned off or when the accelerator switch 58 is turned on. The accelerator switch 58 is turned on when the acceleration pedal in thrust down to increase the engine speed. The accelerator switch 58 is provided to improve the fuel economy.

In FIGS. 5 and 6, the solenoid 25 is excited. With the solenoid 25 excited, the movable core 29 is attracted to the fixed core 28 against the force of the spring 30, as shown in FIG. 5. In FIG. 7, the solenoid 25 is deactivated. With the solenoid 25 deactivated, the movable core 29 is separated from the fixed core 28 due to the force of the spring 30.

With the solenoid 25 activated, the movable core 29 is attracted to the fixed core 28, and the control valve 24 functions as follows. When the suction pressure of the gas, which is supplied via the passage 35 to the second chamber 43 from the suction passage 54, is high the bellows 46 contracts. This occurs when the cooling load is high. The contracting motion is transmitted via the rod 48 to the valve assembly 33 so that the valve assembly 33 moves in a direction that reduces the amount with which the displacement control valve 24 opens.

With a small opening of the valve 24, the amount of gas flowing into the crank chamber 2*a* from the discharge chamber 3*b* via the passage 34, first port 31*a*, hole 38*a*, passage 31*d*, third port 31*c* and passage 37 decreased. Consequently, the pressure in the crank chamber 2*a* falls.

When the cooling load is high, the suction pressure in the cylinder bores 1*a* is high. This decreases the difference between the pressure in the crank chamber 2*a* and the suction pressure in the cylinder bores 1*a*. As a result, the inclined angle of the swash plate 15 increases an shown in FIGS. 1 and 5.

When the suction pressure is low or the cooling load in low, the bellows 46 expands. Consequently, the valve assembly 33 moves in the opening direction to increase the amount of gas flowing into the crank chamber 2*a* from the discharge chamber 3*b*. This raises the pressure in the crank chamber 2*a*.

When the cooling load is low, the suction pressure in the cylinder bores 1*a* is low so that the difference between the pressure in the crank chamber 2*a* and the suction pressure in the cylinder bores 1*a* increases. As a result, the inclined angle of the swash plate 15 becomes smaller.

When the suction pressure becomes very low or when the cooling load does not exist, the valve assembly 33 approaches the maximum opening position as shown in FIG. 6. When the air conditioning switch 57 in turned off or the accelerator switch 58 in turned on to deactivate the solenoid 25, the movable core 29 moves away from the fixed core 28 due to the force of the spring 30. This causes the valve assembly 33 to move to the maximum opening position as shown in FIG. 7.

In the maximum open state as shown in FIG. 7 or in a state close to the maximum open state as shown in FIG. 6, a large amount of the gas in the discharge chamber 3b flows into the crank chamber 2a. The pressure in the crank chamber 2a therefore rises to the maximum level, and the swash plate 15 moves toward the minimum inclination.

As the swash plate 15 moves toward the minimum inclination, the support 14 moves toward the spool 21, causing the pipe 56 to push the inner race 53b of the ball bearing 53. As a result, the spool 21 moves toward the restricting surface 55.

The approach of the spool 21 to the restricting surface 55 restricts the area of the gas-passing cross section between the suction passage 54 and the suction chamber 3a. This restriction reduces the amount of gas flowing into the suction chamber 3a from the suction passage 54. The amount of the gas supplied into the cylinder bores 1a from the suction chamber 3a also decreases, thus reducing the discharge displacement. An a result, the discharge pressure falls, reducing the driving torque-needed by the compressor.

Even If the valve assembly 33 is moved to the opening position and a large Amount of gas in the discharge chamber 3b enters the crank chamber 2a, there is a certain amount of time that it takes to increase the pressure in the crank chamber 2a. Thus, the swash plate 15 gradually moves toward the minimum inclination. Likewise, the change in the discharge displacement of the compressor will not experience rapid changes and the driving torque needed by the compressor. It is therefore possible to prevent a large change in the compressor's torque.

When the small-diameter portion, 21b, of the spool 21 abuts on the restricting surface 55, the gas flow to the suction chamber 3a from the external refrigerant circuit 49 is blocked and the swash plate 15 moves to a minimum inclined angle.

Since the angle of the swash plate 15 is not 0 degrees at this time, the piston 22 reciprocates even in this condition to discharge the gas to the discharge chamber 3b from the associated cylinder bore 1a. With the gas flow to the suction chamber 3a from the external refrigerant circuit 49 so blocked, the gas discharged to the discharge chamber 3b from the associated cylinder bore 1a flows into the crank chamber 2a via the path of the passage 34, port 31a, hole 38a, port 31c and passage 37. The gas in the crank chamber 2a enters the suction chamber 3a via the restricting passage 1b. The gas in the suction chamber 3a is supplied to the cylinder bores 1a and is discharged to the discharge chamber 3b.

With the swash plate 15 at a minimum inclined angle, a short gas circulation circuit consisting of the cylinder bore 1a, discharge chamber 3b, passage 34, control valve 24, passage 37, crank chamber 2a, passage 1b, suction chamber 3a and cylinder bore 1a is formed in the compressor. Thus, the movable portions, such as the ball bearings in the compressor, are lubricated with the lubricating oil suspended in the circulating gas, ensuring the adequate continuous operation of the compressor.

As the gas circulates through the circulation circuit, having the restrictions explained above, there are pressure differences which are created among the discharge chamber 3b, crank chamber 2a and suction chamber 3a. The gas inside the compressor will not flow out to the external refrigerant circuit 49. Consequently, the frosting of the evaporator 52 is unlikely.

Since the pipe 56 is held between the support 14 and the inner race 53b, the pipe 56 rotates with the drive shaft 9. Due to the contact between the pipe 56 and the inner race 53b of the ball bearing 53, the drive shaft 9, support 14, pipe 56 and inner race 53b rotate together, causing no friction among the support 14, pipe 56 and inner race 53b.

When the suction pressure rises due to an increase in cooling, load, the increased suction pressure is transmitted to the second chamber 43 via the suction passage 54 and passage 35. Consequently, the bellows 46 contracts and the valve assembly 33 closes the passage 31d. When the air conditioning switch 57 is turned on or the accelerator switch 58 is turned off on the other hand, the solenoid 25 in activated, causing the movable core 29 to be attached to the fixed core 28. The bellows 46 and the rod 48, therefore, move together with the movable core 29, causing the valve assembly 33 to move in the direction to obstruct the passage 31d due to the force of the spring 39.

When the valve assembly 33 blocks the passage 31d, the path from the discharge chamber 3b to the crank chamber 2a is closed. Consequently, the pressure in the crank chamber 2a gradually decreases, moving the swash plate 15 to a maximum inclined angle from a minimum inclined angle.

The movement of the swash plate 15 causes the support 14 to move in the same direction. Due to the force of the spring 36, the spool 21 moves in response to the movement of the support 14. As a result, the distal end of the spool 21 moves away from the restricting surface 55.

The separation of the spool 21 increase the cross sectional area of the passage between the suction passage 54 and the suction chamber 3a. The increased cross-sectional area increases the amount of gas that can flow into the suction chamber 3a from the suction passage 54. Accordingly, the amount of the gas supplied into the cylinder bores 1a from the suction chamber 3a also increases, thus increasing the discharge displacement. As a result, the discharge pressure rises, increasing the driving torque needed by the compressor.

Even in this case, the rising of the pressure in the crank chamber 2a taken place gradually, and the swash plate 15 moves toward the maximum inclination gradually. The increase of the discharge pressure changes slowly, thus eliminating the need for quick changes to be made to the torque needed by the compressor. It is therefore possible to prevent shocks caused by a large change in torque from occurring in the compressor.

Figure 8A:
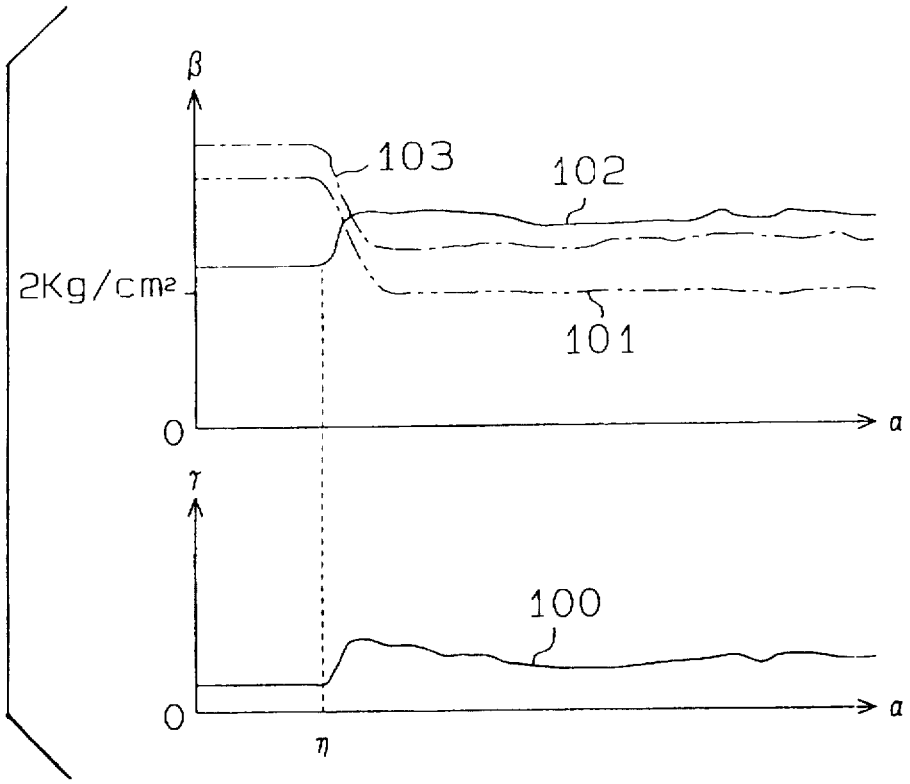
FIG. 8A is a graph showing the results of an experiment on a variation in torque in the compressor of the present invention.

FIG. 8A presents a graph showing the results of an experiment on variations made to the torque of the compressor according to this embodiment. A curve 100 is a torque variation curve, a curve 101 represents a change in pressure in the suction chamber 3a, a curve 102 represents a change in pressure in the discharge chamber 3d, and a curve 103 represents a change in pressure in the crank chamber 2a. The horizontal scale $\alpha$ represents the time, the vertical scale $\beta$ represents the pressure and the vertical scale $\gamma$ represents the torque. In this graph, the deactivated solenoid 25 is activated at time $\eta$.

Figure 8B:
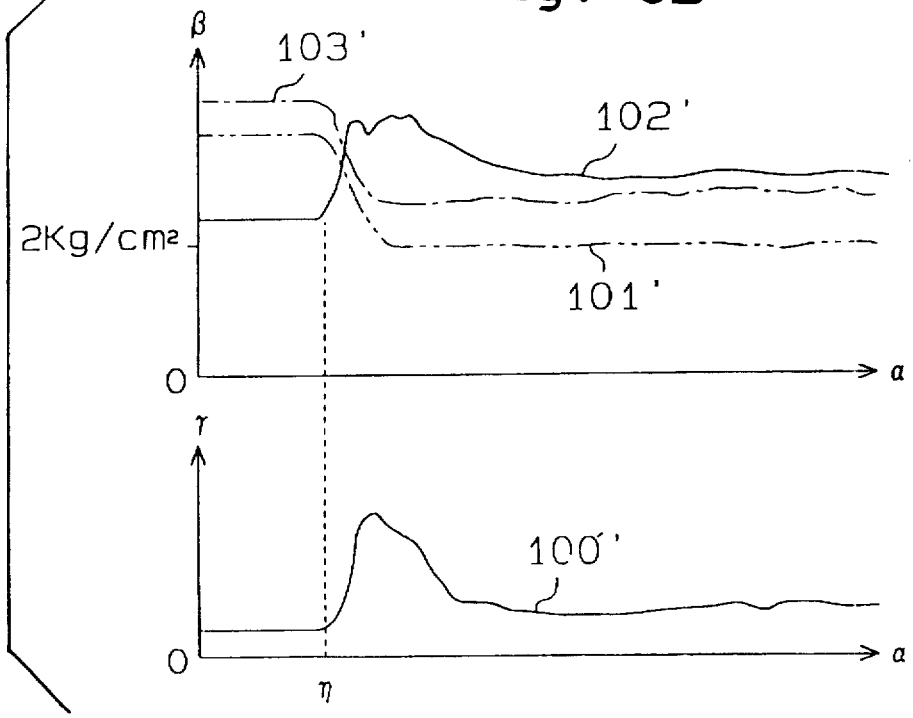
FIG. 8B is a graph showing the results of an experiment on a variation in torque when the flow of a refrigerant gas into the compressor from an external refrigerant circuit is instantaneously stopped.

The graph in FIG. 8B shows the results of an experiment on a variation in torque when the flow of the refrigerant gas into the suction passage 54 from the external refrigerant circuit 49 in the compressor of this embodiment is completely obstructed at time $\eta$.

The action of restricting the supply of the intake gas in the compressor disclosed in Japanese Unexamined Patent Publication No. 3-37378 in the same as that where the flow of the refrigerant gas into the suction passage 54 from the external refrigerant circuit 49 in completely obstructed. A curve 100' is a torque variation curve, a curve 101' represents a change in pressure in the suction chamber 3*a*, a curve 102' represents a change in pressure in the discharge chamber 3*d*, and a curve 103' represents a change in pressure in the crank chamber 2*a*.

It is apparent from the comparison between the two graphs that the change in the discharge pressure curve 102 immediately after time η is smaller and gentler than that in the discharge pressure curve 102'. Likewise, the change in the torque variation curve 100 immediately after time η is smaller and gentler than that in the torque variation curve 100'.

It is apparent from the experimental results that the changes in driving torque and shocks originating therefore in compressors according to the present invention is a vast improvement over that of the compressor as disclosed in Japanese Unexamined Patent Publication No. 3-37378. In the No. 3-37378 publication, when the electromagnetic valve is deactivated, the pressure in the suction chamber remains low and the refrigerant gas in the suction chamber is not indicative of the cooling load. A pressure sensor for detecting the suction pressure 1*a* thus provided between the evaporator and the electromagnetic valve in the conventional compressor.

According to this embodiment, by contrast, the suction-pressure introducing position of the displacement control valve 24*a*, which responds to the suction pressure, is located upstream of the position at which the gas flow is blocked by the spool 21. The control valve 24*a* can thus always respond to a change in cooling load. When the cooling load is produced and the suction pressure rises, the control valve 24*a* instantaneously responds to the rise in suction pressure, consequently the inclined angle of the swash plate 15 increases from a minimum inclined angle unless the solenoid 25 is deactivated.

In short, the compressor according to this embodiment needs no pressure sensor between the evaporator and the electromagnetic valve and thus has a simpler structure than conventional compressors.

A second embodiment of the present invention will now be described referring to FIGS. 9 through 12.

The second embodiment does not have the passage 1*b* provided between the suction chamber 3*a* and the crank chamber 2*a*.

A passage 59 formed in the axial position of the delve shaft 9, has an inlet port 59*a* open to the crank chamber 2*a* in the vicinity of the lip seal 12, and an outlet port 59*b* open to the area where the spool 21 slides in contact with the drive shaft 9. The opening of the passage 59 at one end of the drive shaft 9 is closed by the ball 41 and spring 42.

Figure 9:
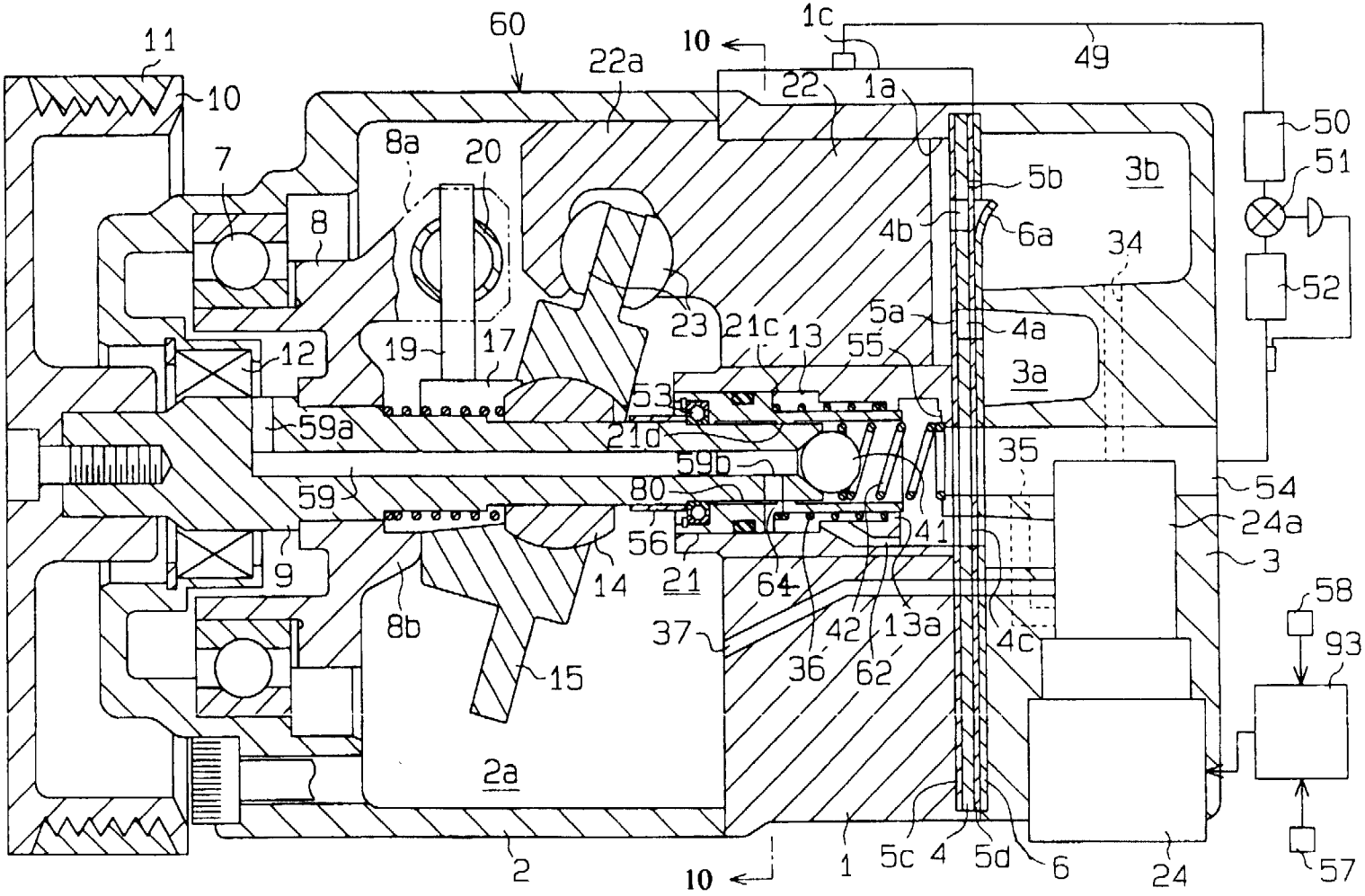
FIGS. 9 through 12 illustrate a second embodiment of the present invention.
Figure 10:
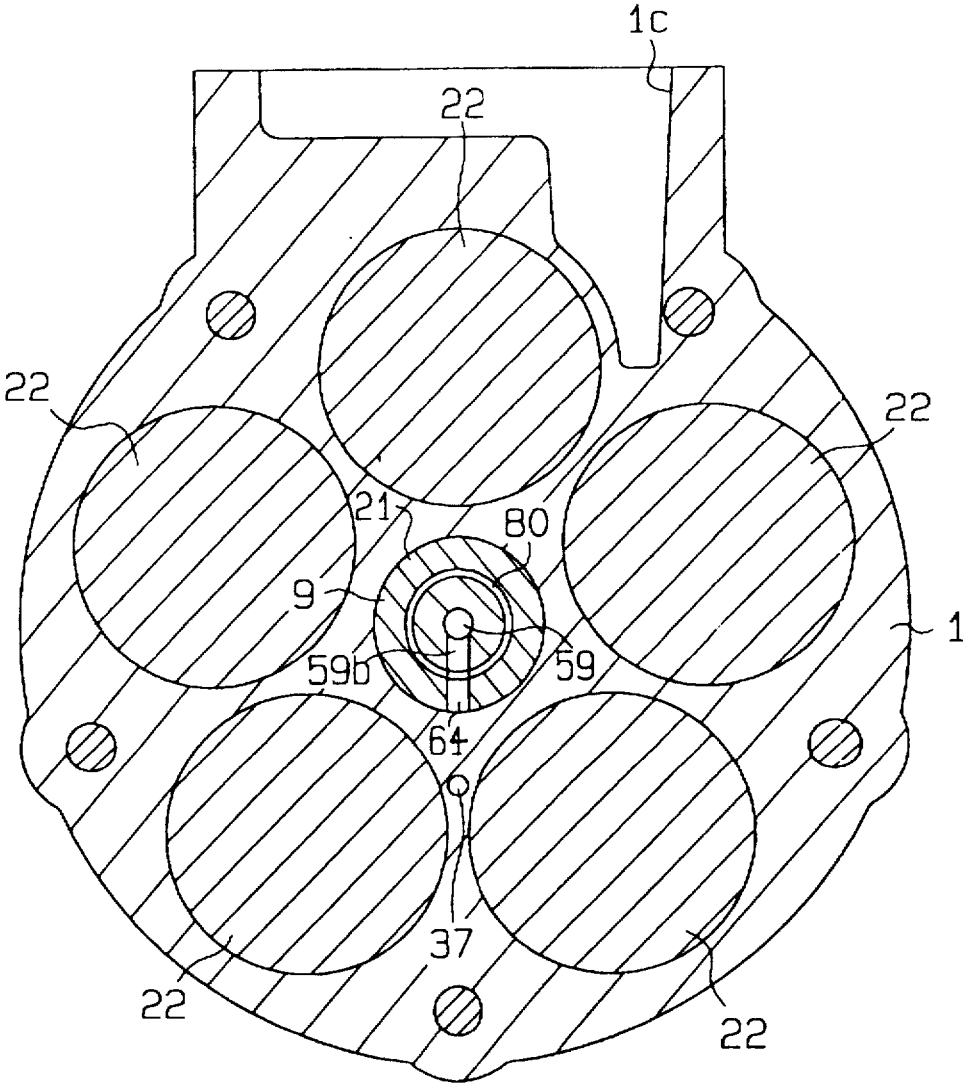
Figure 11:
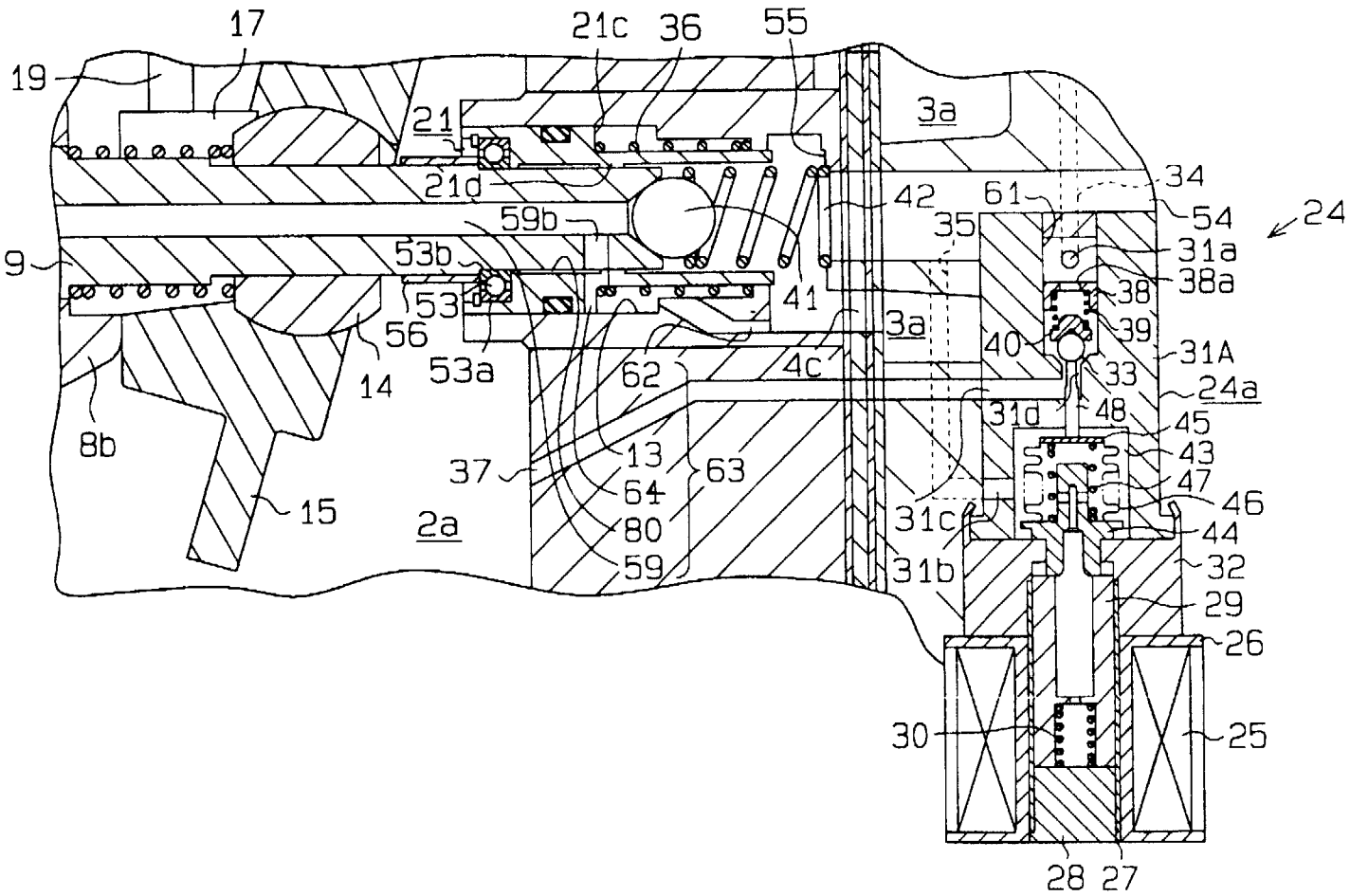
Figure 12:
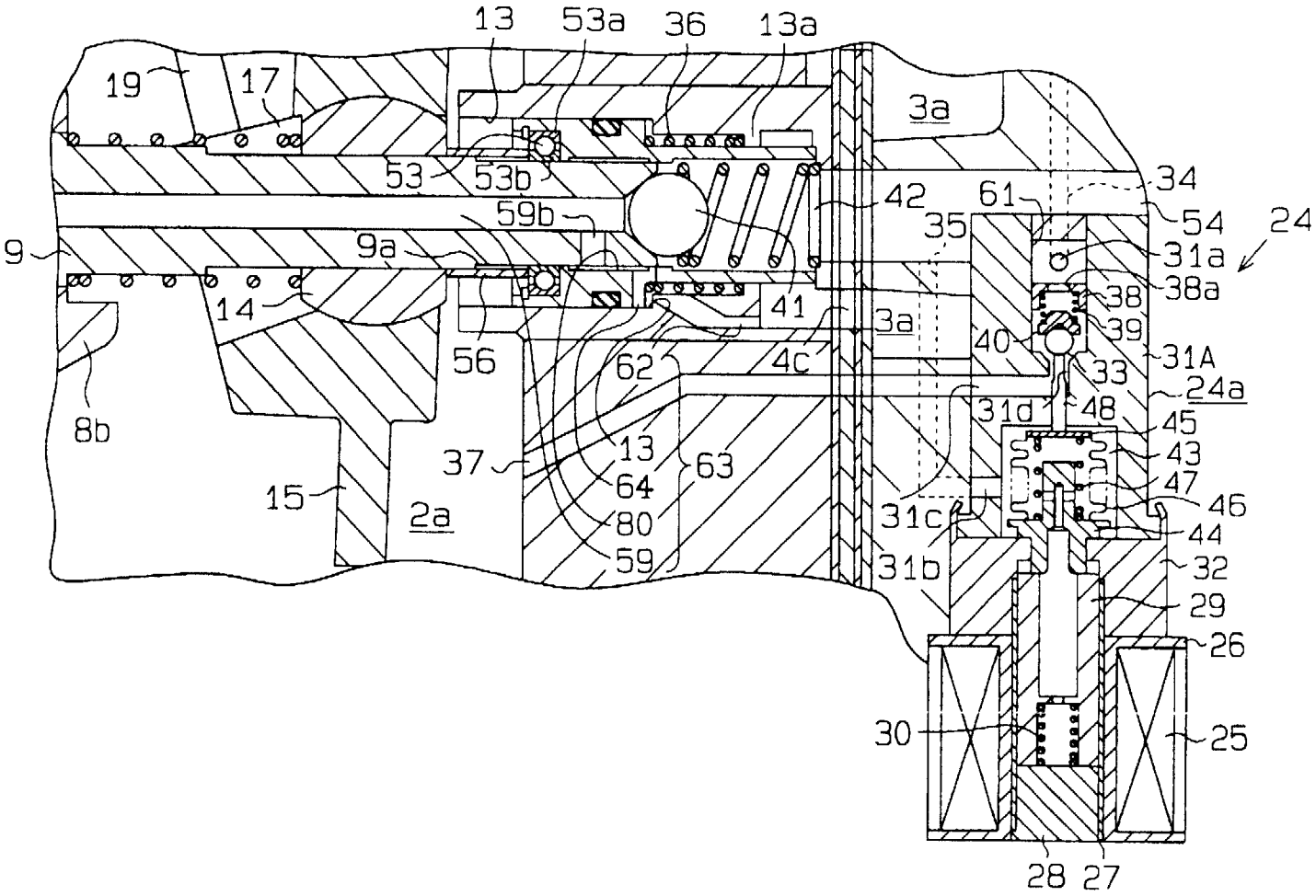

As shown in FIG. 9, an annular passage 80 is formed in the inner wall of the spool 21, and the outlet port 59*b* of the passage 59 is always connected to the passage 80 in the spool 21.

Formed in the vicinity of the step 21*c* of the spool 21 is a passage 64 penetrating through the spool 21. The passage 64 allows the passage 80 to communicate with the retainer hole 13. The retainer hole 13 and the passage 4*c* are connected together via a restricting passage 62. The outlet port of the restricting passage 62 is located downstream of the restricting surface 55.

In other words, the crank chamber 2*a* communicates with the suction chamber 3*a* via a passage 63 formed by the passages 59, 80, and 64, the retainer hole 13 and the restricting passage 62. The gas in the crank chamber 2*a* flows out into the suction chamber 3*a* via the passage 63. The cross-sectional area of the restricting passage 62, which constitutes a part of the passage 63, is smaller than the cross-sectional areas of the passages 59, 80 and 64 The gas flow undergoes a restriction in the restricting passage 62.

The outlet port of the control passage 37 is directed to the peripheral portion of the swash plate 15.

When the inclined angle of the swash plate 15 is at a minimum, a circulatory system is formed among the cylinder bore 1*a*, the discharge chamber 3*b*, the passage 34, the passage in the control valve 24, the passage 37, the crank chamber 2*a*, the passage 63, the suction chamber 3*a*, and the cylinder bore 1*a*.

To properly control the inclined angle of the swash plate 15, the pressure in the crank chamber 2*a* should be set to the proper level. This requires that the amount of gas flowing into the suction chamber 3*a* from the passage 63 be accurately regulated. The amount of the gas flow is regulated by the restricting passage 62 which is a part of the pressure discharge passage 63. If gas leaks in somewhere in the pressure discharge passage 63, however, the inclined angle of the swash plate 15 cannot be controlled properly.

The gas leak from the pressure discharge passage 63 is likely to occur at the clearance between the outer surface of the drive shaft 9 and the inner wall of the spool 21. To prevent the gas leakage, the outer surface of the drive shaft 9 should contact the inner wall of the spool 21 as closely as possible. This structure increases the friction between the drive shaft 9 and the spool 21. In the clutchless compressor, the drive shaft 9 keeps rotating unless the external driving source is stopped. The large friction between the drive shaft 9 and the spool 21 thus causes wearing or burning therebetween.

If burning occurs between the drive shaft 9 and the spool 21, the spool 21 cannot slide, disabling the control on the inclined angle of the swash plate 15. If the drive shaft 9 and the spool 21 wear out, the gas leakage from the pressure discharge passage 63 increases no that the inclined angle of the swash plate 15 in turn cannot be accurately controlled.

According to the second embodiment, when the spool 21 does not abut the restricting surface 55, the open position, the gas in the crank chamber 2*a* flows into the suction chamber 3*a* via the pressure discharge passage 63. When the spool 21 abuts the restricting surface 55, the gas in the discharge chamber 3*b* circulated through the passage 34, control valve 24, control passage 37, crank chamber 2*a*, passage 63, suction chamber 3*a* and cylinder bore 1*a* and returns to the discharge chamber 3*b*. The passage 80 which is a part of the passage 63 is located in the slidable area between the drive shaft 9 and the spool 21. This slidable area is lubricated with the lubricating oil that flows together with the gas.

Therefore, the wearing or burning of the drive shaft 9 and the spool 21 in prevented.

The lubricating oil enters between the drive shaft 9 and the spool 21 to enhance the sealing therebetween, so that the gas leakage from between the drive shaft 9 and the spool 21 is prevented. The adequate lubrication of the slidable area between the drive shaft 9 and the spool 21 contributes to the smooth sliding of the spool 21. This promotes smooth gas flow restriction and increasing of the cross-sectional area of the restricting passage 62.

In addition, due to the fact that the retainer hole 13 is a part of the passage 63 and that the slidable area between the spool 21 and the cylinder block 1 is lubricated with oil carried along with the refrigerant gas, the sliding action of the spool 21 becomes smoother.

According to the second embodiment, as described above, the wearing or burning of the drive shaft 9 and spool 21 can be prevented and the smooth movement of the spool 21 is enhanced so that the inclined angle of the swash plate 15 can be more accurately controlled. An enhanced compressor displacement control is therefore possible.

Since the inlet port 59*a* of the passage 63 is located near the lip seal 12, the lubricating oil, and refrigerant gas flowing through the passage 63 improves the sealing performance of the lip seal 12. Moreover, since the outlet port of the control passage 37 in directed to the peripheral portion of the swash plate 15, the gas flowing into the crank chamber 2*a* from the passage 37 hits the sliding portions between the swash plate 15 and the shoes 23. The gas thereby lubricates these sliding portions.

Although only two embodiments of the present invention have been described herein, it should be apparent to those skilled in the art that the present invention may be embodied in many other specific forms without departing from the spirit or scope of the invention. Particularly, it should be understood that the following modes are to be applied.

(1) The support and the spool may be integrated.

(2) To effect the shifting of the spool between the position where a passage from the external refrigerant circuit to the suction chamber in closed and the position where that passage is opened, the pressure in the crank chamber may directly act on the spool. That is the spool may be shifted in accordance with the difference between the pressure in the crank chamber and the suction pressure, rather than the inclined angle of the swash plate.

Figure 13:
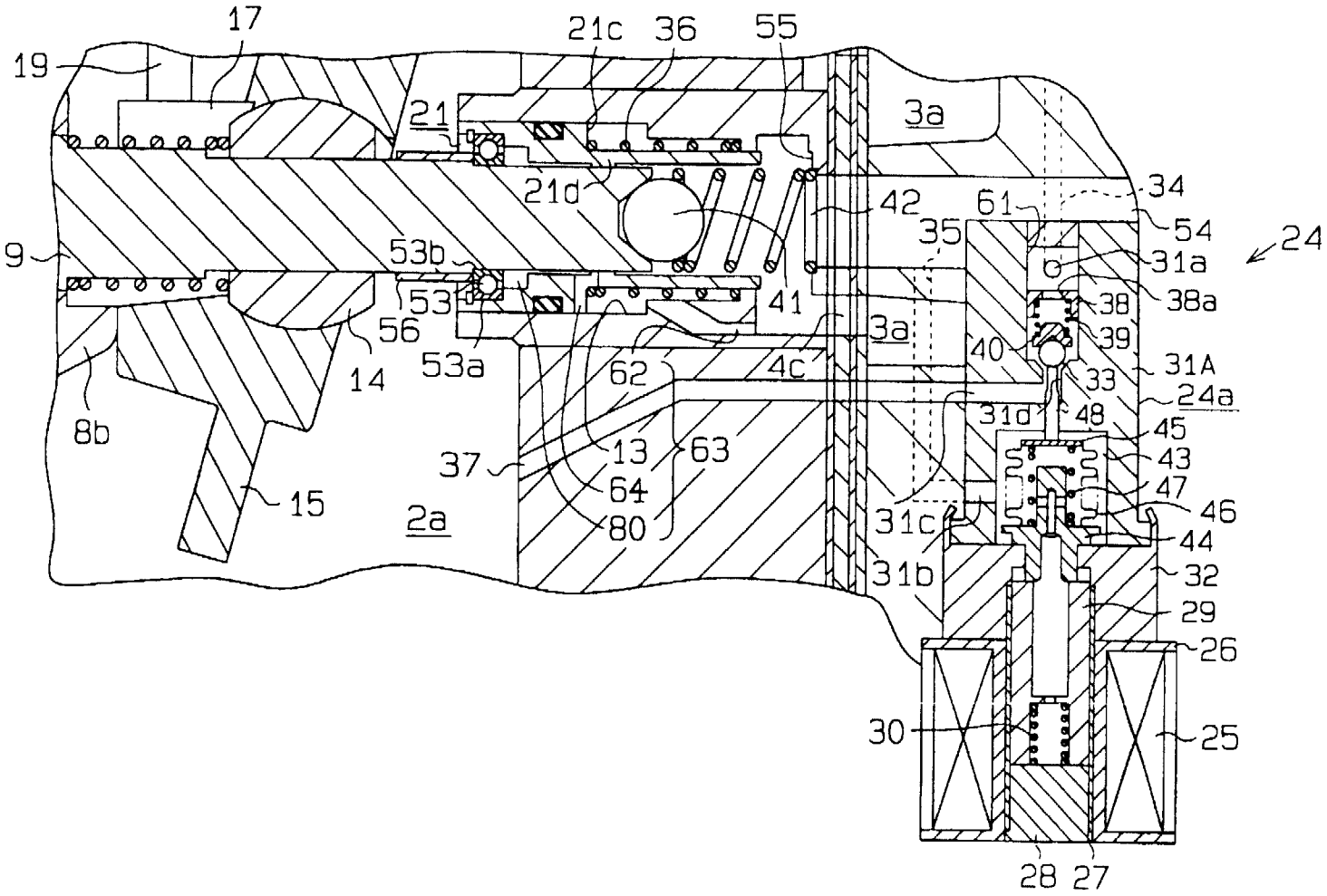
FIG. 13 is an enlarged fragmentary cross-sectional view showing the essential portions of another embodiment of the present invention.

(3) An embodiment as shown in FIG. 13 may be worked out. In this embodiment, the passage 80 in the inner wall of the spool 21 communicates with the clearance between the outer race 53*a* and inner race 53*b* of the ball bearing 53. This allows oil communication without the need of the passage 59 in the drive shaft 9. The gas in the crank chamber 2*a* flows into the passage 80 through the clearance between the outer race 53*a* and inner race 53*b*. The slidable area between the drive shaft 9 and the spool 21 can be lubricated sufficiently as per the previous embodiments, however, this embodiment ensures better lubrication of the ball bearing 53 than the previous embodiments.

Therefore, the present examples and embodiments are to be considered as illustrative and not restrictive and the invention in not to be limited to the details given herein, but may be modified within the scope of the appended claims.

What is claimed is:

1. A compressor having a refrigerant gas passage connected to a refrigerant circuit separately provided from the compressor, said compressor having a plurality of reciprocable pistons for compressing refrigerant gas, said compressor comprising:

a housing having a refrigerant discharge chambers a refrigerant suction chamber, and a crank chamber;

a plurality of cylinder bores disposed in the housing, said cylinder bores communicating with said discharge chamber and said suction chamber and each of said cylinder bores accommodating one of said pistons;

a drive shaft rotatably supported in the housing;

a swash plate supported on the drive shaft for integral rotation with inclining motion with respect to the drive shaft in the crank chamber to drive the pistons, said swash plate being moveable between a maximum inclined angle and a minimum inclined angle greater than zero; and means for selectively connecting and disconnecting said refrigerant circuit to and from the refrigerant gas passage in direct association with the variable inclination of the swash plate.

2. A compressor operated in accordance with operating conditions computed by a computer electrically connected to the compressor, and having a refrigerant gas passage connected via an evaporator to a refrigerant circuit separately provided from the compressor, said compressor having a plurality of reciprocable pistons for compressing gas, said compressor further comprising:

a housing having a refrigerant discharge chamber and a refrigerant suction chamber;

a crank chamber disposed in the housing;

a plurality of cylinder bores communicating with said refrigerant gas passage in the housing, each cylinder bore communicating with said discharge chamber and said suction chamber and accommodating one of said pistons;

a drive shaft rotatably supported in the housing;

a swash plate supported on the drive shaft for driven rotation therewith and variable inclination relative thereto in the crank chamber to drive the pistons, said swash plate being moveable between a maximum inclined angle and a minimum inclined angle greater than zero;

a first passage for connecting the crank chamber and the suction chamber for delivering the refrigerant gas from the crank chamber to the suction chamber;

a second passage for connecting the discharge chamber and the crank chamber for delivering the refrigerant gas from the discharge chamber to the crank chamber;

driving means for driving the swash plate in accordance with an electric signal indicative of the operating conditions of the compressor, said signal being transmitted from the computer;

disconnecting means for disconnecting said refrigerant circuit and the refrigerant gas passage when the swash plate is at the minimum inclined angle; and a circulating passage including the first passage and the second passage, said circulating passage being formed upon disconnection of the refrigerant circuit and the refrigerant.

3. A compressor as set forth in claim 2, wherein said first passage include an orifice.

4. A compressor as set forth in claim 2, wherein said driving means includes a drive valve for selectively opening and closing the second passage.

5. A compressor as set forth in claim 4, wherein said valve in an electromagnetic valve.

6. A compressor as set forth in claim 4 further comprising a control valve for controlling differences between pressures in the crank chamber and in the suction chamber to hold the swash plate at the inclining angle based on the difference between the two pressures.

7. A compressor as set forth in claim 6, wherein the control valve controls the quantity of the refrigerant gas flowing in the refrigerant gas passage which communicates with the suction chamber.

8. A compressor as set forth in claim 7, wherein said control valve is coupled responsively to the refrigerant gas passage upstream of the disconnecting means.

9. A compressor as set forth in claim 7, wherein said control valve is disposed in the second passage for opening the second passage in accordance with the decrease of the pressure of the refrigerant gas which is sucked into the second passage.

10. A compressor as set forth in claim 7, wherein said control valve includes a bellows capable of selectively contracting and expanding in accordance with the magnitude of the pressure of the refrigerant gas for changing the inclining angle of the swash plate.

11. A compressor as set forth in claim 6, wherein said control valve is formed integrally with the drive valve.

12. A compressor as set forth in claim 6, wherein the first passage extends through an area located between the spool and housing.

13. A compressor as set forth in claim 6, wherein said first passage extends within the drive shaft, said first passage having an inlet communicating with said crank chamber and an outlet communicating with an area defined by two ends of the moving region of the spool.

14. A compressor as set forth in claim 13 further comprising a seal member disposed between the drive shaft and housing for airtightly sealing the crankcase, wherein an outlet of the first passage in disposed adjacent to the seal member.

15. A compressor as set forth in claim 2, wherein said disconnecting means is disposed between the evaporator and the cylinder bores.

16. A compressor as set forth in claim 2, wherein said disconnecting means is disposed between the evaporator and the suction chamber.

17. A compressor as set forth in claim 2, wherein said disconnecting means includes a spool supported in the housing, said spool being arranged to slide along the refrigerant passage.

18. A compressor as set forth in claim 17, wherein the spool in supported on the drive shaft to move in the axial direction thereof.

19. A compressor as set forth in claim 18 further comprising a bearing for supporting the drive shaft, wherein the spool and the swash plate are operably connected by way of the bearing.

20. A compressor as set forth in claim 19, wherein the spool forceably holds the swash plate at the minimum angle position when the spool disconnects the refrigerant gas passage and the refrigerant circuit.

21. A compressor as set forth in claim 2, wherein the second passage opens to the crank chamber and directed towards the swash plate.

22. A compressor operated in accordance with operating conditions computed by a computer connected to the compressor, and having a refrigerant gas passage connected via an evaporator to a refrigerant circuit separately provided from the compressor, said compressor having a plurality of reciprocable pistons for compressing the refrigerant gas, said compressor comprising:

a housing having a refrigerant discharge chamber and a refrigerant suction chamber;

a crank chamber disposed in the housing;

a plurality of cylinder bores communicating with said refrigerant gas passage in the housing, each cylinder bore communicating with said discharge chamber and said suction chamber and accommodating one of said pistons;

a drive shaft rotatably supported by the housing;

a swash plate supported on the drive shaft for integral rotation with inclining motion with respect to the drive shaft in the crank chamber for driving the pistons, said swash plate being moveable between a maximum inclined angle and a minimun inclined angle;

a first passage for connecting the crank chamber and the suction chamber for delivering the refrigerant gas from the crank chamber to the suction chamber, said first passage having an orifice;

a second passage for connecting the discharge chamber and the crank chamber for delivering the refrigerant gas from the discharge chamber to the crank chamber;

drive means for driving the swash plate in accordance with an electric signal indicative of the operating conditions of the compressor, said signal being transmitted from the computer, and said drive means including a drive valve disposed in the second passage for selectively opening and closing the second passage;

a spool operably connected to the swash plate and supported on the drive shaft to slide in the axial direction thereof in the passage between the evaporator and the cylinder bores, for disconnecting said refrigerant circuit and the refrigerant gas passage and connecting the first circuit with the second circuit to form a circulating circuit of the refrigerant gas when the swash plate is at the minimum inclined angle; and a control valve for controlling differences between pressures in the crank chamber and in the suction chamber to hold the swash plate at the inclining angle based on the difference between the two pressures, said control valve being formed integrally with the drive valve.

23. A compressor having a refrigerant gas passage selectively connected to and disconnected from a refrigerant circuit separately provided from the compressor, said compressor having a plurality of pistons reciprocal in a housing for compressing gas, said compressor further comprising:

a drive shaft rotatably supported by the housing;

a swash plate supported on the drive shaft for driven rotation therewith and variable inclination relative thereto to drive the pistons, said swash plate being movable between a maximum inclined angle and a minimum inclined angle greater than zero;

disconnecting means for disconnecting said refrigerant circuit from said refrigerant gas passage when the swash plate is at said minimum inclined angle; and control means coupled responsively to said refrigerant gas passage upstream of said disconnecting means for controlling the inclined angle of the swash plate in accordance with the pressure of the refrigerant gas sucked from the refrigerant circuit into the refrigerant gas passage.

24. A compressor having a refrigerant gas passage connected to a refrigerant circuit separately provided from the compressor, said compressor having a plurality of reciprocable pistons for compressing refrigerant gas, said compressor further comprising:

a housing having a refrigerant discharge chamber and a refrigerant suction chamber;

a plurality of cylinder bores disposed in the housing, said cylinder bores communicating with said discharge chamber and said suction chamber, and each of said cylinder bores accommodating one of said pistons;

a drive shaft rotatably supported in the housing;

a swash plate supported on the drive shaft for driven rotation therewith and variable inclination relative thereto in a crank chamber to drive the pistons, said swash plate being movable between a maximum inclined angle and a minimum inclined angle greater than zero; and disconnecting means for disconnecting said refrigerant circuit from the refrigerant gas passage when the swash plate is at the minimum inclined angle;

said refrigerant gas passage including:

a first passage for connecting the crank chamber and the suction chamber for delivering the refrigerant gas from the crank chamber to the suction chamber;

a second passage for connecting the discharge chamber and the crank chamber for delivering the refrigerant gas from the discharge chamber to the crank chamber; and a circulating passage including the first passage and the second passage, said circulating passage being formed upon disconnection of the refrigerant circuit and the refrigerant gas passage.

25. A compressor as set forth in claim 24, wherein said first passage includes an orifice.

26. A compressor as set forth in claim 25 further comprising control means for controlling the inclining angle of the swash plate in accordance with the magnitude of the pressure magnitude of the refrigerant gas sucked from the refrigerant circuit into the refrigerant gas passage.

27. A compressor as set forth in claim 26, wherein said control means includes a valve for opening the second passage in accordance with the magnitude of the pressure of the refrigerant gas.

28. A compressor as set forth in claim 27, wherein said control means is coupled responsively to said refrigerant gas passage upstream of said disconnecting means.

29. A compressor as set forth in claim 28, wherein a computer apart from the compressor is electrically connected to the compressor, said computer computing conditions relative to the operation of the compressor.

30. A compressor as set forth in claim 29 further comprising means for driving the swash plate in accordance with an electric signal indicative of the operating conditions of the compressor, said signal being transmitted from the computer.

31. A compressor as set forth in claim 30, wherein said driving means includes a valve for selectively opening and closing the second passage.

32. A compressor as set forth in claim 30, wherein said driving means is formed integrally with the control means.

33. A compressor having a refrigerant gas passage connected to a refrigerant circuit separately provided from the compressor, said compressor having a plurality of reciprocable pistons for compressing gas, said compressor further comprising:

a housing having a refrigerant discharge chamber and a refrigerant suction chamber;

a plurality of cylinder bores disposed in the housing, said cylinder bores communicating with said discharge chamber and said suction chamber, and each of said cylinder bores accommodating one of said pistons;

a drive shaft rotatably supported in the housing;

a swash plate supported on the drive shaft for driven rotation therewith and variable inclination relative thereto in a crank chamber to drive the pistons, said swash plate being movable between a maximum inclined angle and a minimum inclined angle greater than zero; and disconnecting means for disconnecting said refrigerant circuit from the refrigerant gas passage when the swash plate is at the minimum inclined angle;

said disconnecting means including a spool supported in the housing, said spool being supported on the drive shaft to move in the axial direction thereof and constructed to slide along the refrigerant passage.

34. A compressor having a refrigerant gas passage selectively connected to and disconnected from a refrigerant circuit separately provided from the compressor, said compressor having a plurality of pistons reciprocal in a housing for compressing gas, said compressor further comprising:

a drive shaft rotatably supported by the housing;

a swash plate supported on the drive shaft for driven rotation therewith and variable inclination relative thereto to drive the pistons, said swash plate being movable between a maximum inclined angle and a minimum inclined angle greater than zero;

disconnecting means for disconnecting said refrigerant circuit from said refrigerant gas passage when the swash plate is at said minimum inclined angle; and control means for controlling the inclined angle of the swash plate to change the displacement of the compressor, said control means being actuated to minimize the inclined angle of the swash plate to establish a substantially non-operating compressor status in response to an electrical signal.

35. A compressor having a refrigerant gas passage selectively connected to and disconnected from a refrigerant circuit separately provided from the compressor, said compressor having a plurality of pistons reciprocal in a housing for compressing gas, said compressor further comprising:

a drive shaft rotatably supported by the housing;

a swash plate supported on the drive shaft for driven rotation therewith and variable inclination relative thereto to drive the pistons, said swash plate being movable between a maximum inclined angle and a minimum inclined angle greater than zero;

disconnecting means for disconnecting said refrigerant circuit from said refrigerant gas passage when the swash plate is at said minimum inclined angle; and control means for controlling the inclined angle of the swash plate to change the displacement of the compressor, said control means including actuating means for actuating the disconnecting means to control the gas flowing into the compressor.

36. A compressor having a refrigerant gas passage selectively connected to and disconnected from a refrigerant circuit separately provided from the compressor, said compressor having a housing having a front end and a rear end, a cylinder bore within said housing, a piston within said cylinder bore, means defining a suction region a said rear end of the housing, a crank chamber within said housing, and means defining a discharge region at said rear end of the housing, wherein refrigerant gas containing misted oil is supplied to said suction region from the refrigerant circuit, compressed in said cylinder bore by said piston and discharged to the discharge region, said compressor further comprising:

a drive shaft rotatably supported in said housing by a bearing within said crank chamber at said front end of the housing and bearing means at said rear end of the housing;

a swash plate supported on the drive shaft for driven rotation therewith and variable inclination relative thereto to drive the piston, said swash plate being movable between a maximum inclined angle and a minimum inclined angle greater than zero; and a connecting passage extending within the drive shaft connecting, and for drawing said refrigerant gas from, the crank chamber to the suction region, said passage having an inlet opening near said shaft bearing at the front end of the housing, whereby said misted oil in the refrigerant gas lubricates the bearing as the refrigerant gas flows from the crank chamber into the passage while the swash plate is at its said minimum inclined angle.

37. The compressor as set forth in claim 36, further comprising:

an annular seal interposed between the drive shaft and the housing at said front end of the housing;

said connecting passage inlet opening being open to said seal whereby said misted oil is supplied thereto.

38. A compressor having a refrigerant gas passage connected to a refrigerant circuit separately provided from the compressor, said compressor having a housing that includes a suction region, a crank chamber, and a discharge region, wherein refrigerant gas contains misted oil and is supplied to said suction region from the refrigerant circuit, compressed by a piston reciprocally moving in a cylinder bore and discharged to the discharge region, said compressor further comprising:

a drive shaft rotatably supported by the housing;

a swash plate supported on the drive shaft for driven rotation therewith and variable inclination relative thereto to drive the pistons, said swash plate being movable between a maximum inclined angle and a minimum inclined angle greater than zero;

disconnecting means for disconnecting said refrigerant circuit from said refrigerant gas passage when the swash plate is at said minimum inclined angle;

said refrigerant gas passage including:

a first passage for connecting the crank chamber and the suction region for delivering the refrigerant gas from the crank chamber to the suction region, said first passage including a connecting passage extending within the drive shaft along an axis thereof;

a second passage for connecting the discharge region and the crank chamber for delivering the refrigerant gas from the discharge region to the crank chamber; and a circulating passage including the first passage and the second passage, said circulating passage being formed upon disconnection of the refrigerant circuit and the refrigerant gas passage.

39. The compressor as set forth in claim 38, further comprising:

means interposed therebetween for slidably contacting the drive shaft and the housing; and said connecting passage is open to said slidably contacting means to supply the misted oil thereto.

40. The compressor as set forth in claim 39, wherein said slidably contacting means includes a seal member and a bearing member both interposed between the drive shaft and the housing.

41. A compressor having a cylinder block that includes a cylinder bore, said cylinder block having a front end and a rear end opposed to the front end, a front housing connected to the front end of the cylinder block and forming a crank chamber, and a rear housing connected to said rear end of the cylinder block and forming a suction chamber, wherein refrigerant gas containing misted oil is supplied to the compressor from an external refrigerant circuit, compressed and discharged from the compressor, said compressor comprising:

a drive shaft rotatably supported by the cylinder block and the front housing adjacent to said front end of the cylinder block, the drive shaft having an outer surface and extending through the crank chamber from said front end of the housing to said rear housing;

a swash plate supported on the drive shaft in the crank chamber for driven rotation therewith;

a piston accommodated in the cylinder bore and coupled to the swash plate, whereby rotation of the swash plate is converted to reciprocal movement of the piston in the cylinder bore to compress the refrigerant gas;

slidably contacting means within the crank chamber and interposed between the front housing and the drive shaft adjacent to said front end of the housing; and a gas passage extending within the drive shaft and connecting the crank chamber to the suction chamber, the passage having an opening near said slidably contacting means in the crank chamber, whereby the refrigerant gas in the crank chamber flows to the passage through the slidably contacting means whereby the misted oil in the gas lubricates the slidably contacting means.

42. The compressor as set forth in claim 41, wherein said swash plate is supported on the drive shaft for variable inclination between a maximum inclined angle and a minimum inclined angle greater than zero degree, wherein said slidably contacting means includes an annular seal around the drive shaft between the shaft and the front housing for preventing refrigerant gas in the crank chamber from leaking along the outer surface of the drive shaft out from the crank chamber, and said passage opening is adjacent to said seal whereby the misted oil in the gas lubricates the seal while said swash plate is at its said minimum inclined angle.

43. The compressor as set forth in claim 41, wherein said swash plate is supported on the drive shaft for variable inclination between a maximum inclined angle and a minimum inclined angle greater than zero degree, and wherein said slidably contacting means includes a radial bearing for rotatably supporting the drive shaft within the front housing, and wherein said refrigerant gas flows through said radial bearing while said swash plate is at its said minimum inclined angle.

44. The compressor as set forth in claim 41, wherein said slidably contacting means includes an annular seal around the drive shaft between the shaft and the front housing for preventing refrigerant gas in the crank chamber from leaking along the outer surface of the drive shaft out from the crank chamber, and a radial bearing for rotatably supporting the drive shaft within the front housing, wherein said opening of the gas passage is adjacent to the seal and near the radial bearing.

45. A compressor having a cylinder block that includes a plurality of cylinder bores, said cylinder block having a first end and a second end opposed to the first end, a front housing connected to the first end of the cylinder block and forming a crank chamber, and a rear housing connected to the second end of the cylinder block and forming a suction chamber, wherein refrigerant gas containing a misted oil is supplied to the compressor from an external refrigerant circuit, compressed and discharged from the compressor, said compressor comprising:

a drive shaft rotatably supported by the cylinder block and the front housing, the drive shaft having an outer surface and extending through the crank chamber;

a swash plate supported on the drive shaft for driven rotation therewith within the crank chamber;

a plurality of pistons each respectively accommodated in one of the cylinder bores and all of said pistons being coupled to the swash plate, whereby rotation of the swash plate is converted to reciprocal movement of the pistons in the cylinder bores to compress the refrigerant gas;

a gas passage extending within the drive shaft along an axis thereof, said gas passage having an inlet opening into the crank chamber and an outlet opening communicating with the suction chamber to form a gas flow path from the crank chamber to the suction chamber; and slidably contacting means within the crank chamber and interposed between the front housing and the outer surface of the drive shaft within the gas flow path within the crank chamber to said inlet opening of said drive shaft gas passage, whereby said misted oil in said gas lubricates said slidably contacting means.

46. A variable displacement compressor having a housing having a front end and a rear end, a plurality of cylinder bores, a crank chamber extending to said front end of the housing, and a suction chamber and a discharge chamber in said rear end of the housing, said cylinder bores having respective pistons therein, said compressor comprising:

a drive shaft rotatably supported by the housing at said front end thereof, the drive shaft extending through the crank chamber, and being further rotatably supported by means adjacent to said rear end of the housing;

a swash plate supported on the drive shaft for driven rotation therewith and variable inclination relative thereto to drive the pistons, said pistons being coupled to the swash plate, said swash plate being movable between a maximum inclined angle and a minimum inclined angle greater than zero, whereby rotation of the swash plate is converted to reciprocating movement of the pistons in the cylinder bores to compress refrigerant gas containing misted oil for lubricating parts of said compressor which are in moving contact with each other during operation of the compressor, said gas being supplied to the cylinder bores from said suction chamber to be compressed by the pistons and discharged to the discharge chamber;

a first connecting passage connecting the crank chamber at said front end of the housing to the suction chamber at said rear end of the housing;

a second connecting passage connecting the discharge chamber to the crank chamber;

a control valve disposed in the second connecting passage to change the inclining angle of the swash plate based on a differential pressure between the crank chamber and the suction chamber by changing the opening of the second connecting passage to adjust the pressure in the crank chamber; and slidably contacting means around the drive shaft within said crank chamber at said front end of the housing, the first connecting passage extending within the drive shaft and having an inlet opening within the crank chamber adjacent to the slidably contacting means, whereby the misted oil in said refrigerant gas lubricates the slidably contacting means, and wherein said refrigerant gas circulates through the compressor from the crank chamber, wherein the gas contacts the slidably contacting means, into said opening of the first connecting passage, then through the first connecting passage to the suction chamber, the cylinder bores, the discharge chamber, and the second connecting passage to the crank chamber.

47. The compressor as set forth in claim 46, wherein the drive shaft has an outer surface and a drive shaft end projecting out from said front end of the housing, and said slidably contacting means comprises an annular seal around the drive shaft adjacent to said drive shaft projecting end for preventing refrigerant gas within the crank chamber from leaking therefrom and externally of the compressor via the outer surface of the drive shaft, the seal being between the outer surface of the drive shaft and the housing, said first connecting passage in the drive shaft having an opening near the seal whereby said misted oil lubricates the seal.

48. The compressor as set forth in claim 47, wherein said slidably contacting means further comprises a radial bearing rotatably supporting the drive shaft at said front end of the housing, the radial bearing being between the outer surface of the drive shaft and the housing, said opening of the first connecting passage further being located near the radial bearing, whereby said misted oil lubricates both the seal and the radial bearing.

* * * * *

UNITED STATES PATENT AND TRADEMARK OFFICE

CERTIFICATE OF CORRECTION

PATENT NO. : 5,797,730

DATED : August 25, 1998

INVENTOR(S) : KAWAGUCHI et al.

It is certified that error appears in the above-identified patent and that said Letters Patent is hereby corrected as shown below:

Column 1, line 19, change " eliminate" to --eliminates--;

line 25, change " clutchless systems" to --clutchless system,--;

line 46, after " path" change " in" to --is--;

line 57, after " power" change " loan" to --loss--.

UNITED STATES PATENT AND TRADEMARK OFFICE

CERTIFICATE OF CORRECTION

PATENT NO. : 5,797,730

DATED : August 25, 1998

INVENTOR(S) : KAWAGUCHI et al.

It is certified that error appears in the above-identified patent and that said Letters Patent is hereby corrected as shown below:

Column 2, last line, change " beat" to --best --.

Column 3, line 17, change " a" to --the--;

line 18, after " position" insert a semi-colon --;--;

line 57, change " roar" to --rear--;

line 59, change " in" (first occurrence) to --is --.

Column 4, line 22, change " pine" to --pins--; same line, change " 19" (first occurrence) to --18--;

UNITED STATES PATENT AND TRADEMARK OFFICE

CERTIFICATE OF CORRECTION

PATENT NO. : 5,797,730

DATED : August 25, 1998

INVENTOR(S) : KAWAGUCHI et al.

It is certified that error appears in the above-identified patent and that said Letters Patent is hereby corrected as shown below:

Column 4, line 28, change " in" to --is--;

line 46, change " surf ace" to --surface--.

Column 5, line 2, change " An" to --As--;

line 10, change " in" to --is--;

line 29, change " in" to --is --;

line 57, change " it" to --is--;

line 58, change " in" to --is--;

UNITED STATES PATENT AND TRADEMARK OFFICE

CERTIFICATE OF CORRECTION

PATENT NO. : 5,797,730

DATED : August 25, 1998

INVENTOR(S) : KAWAGUCHI et al.

It is certified that error appears in the above-identified patent and that said Letters Patent is hereby corrected as shown below:

Column 6, line 9, change " in" to --is--;

line 14, change " 1a" to --is--;

line 22, change " in" to --is--;

line 24, change " in" to --is--;

line 55, change " in" to --is --.

Column 7, line 2, change " in" to --is--;

line 3, change " in" to --is--;

line 26, change " An" to --As--;

UNITED STATES PATENT AND TRADEMARK OFFICE

CERTIFICATE OF CORRECTION

PATENT NO. : 5,797,730

DATED : August 25, 1998

INVENTOR(S) : KAWAGUCHI et al.

It is certified that error appears in the above-identified patent and that said Letters Patent is hereby corrected as shown below:

Column 7, line 27, delete the " hyphen" (-) between " torque" and " needed" ;

line 28, change " If" to --if--;

line 29, change " Amount" to --amount--;

Column 8, line 17, change " in" to --is --;

line 34, change " increase" to --increases--.

Column 9, line 27, change " 1a" to --is--;

line 51, change " delve" to --drive--;

UNITED STATES PATENT AND TRADEMARK OFFICE

CERTIFICATE OF CORRECTION

PATENT NO. : 5,797,730

DATED : August 25, 1998

INVENTOR(S) : KAWAGUCHI et al.

It is certified that error appears in the above-identified patent and that said Letters Patent is hereby corrected as shown below:

Column 10, line 50, change " circulated" to --circulates--;

line 59, change " in" to --is--.

Column 11, line 30, change " in" to --is--;

line 50, change " in" to --is--;

line 59, change " chambers" to --chamber,--.

Column 13, line 37, change " in" to --is--;

line 48, before " directed" insert --is--.

Column 16, line 50, after " region" change " a" to --at--.

Signed and Sealed this

Twelfth Day of September, 2000

*Attest:*

Q. TODD DICKINSON

*Attesting Officer*

*Director of Patents and Trademarks*